US011819138B2

(12) United States Patent
Mascull

(10) Patent No.: US 11,819,138 B2
(45) Date of Patent: Nov. 21, 2023

(54) SEATING SUPPORT

(71) Applicant: Roger Thomas Mascull and Elizabeth Jocelyn Mascull as Trustees of the RT and EJ Mascull Family Trust, Rolleston (NZ)

(72) Inventor: Bruce Gordon Mascull, Rolleston (NZ)

(73) Assignee: Roger Thomas Mascull and Elizabeth Jocelyn Mascull as Trustees of the RT and EJ Mascull Family Trust, Rolleston (NZ)

( * ) Notice: Subject to any disclaimer, the term of this patent is extended or adjusted under 35 U.S.C. 154(b) by 117 days.

(21) Appl. No.: 16/976,212

(22) PCT Filed: Feb. 26, 2019

(86) PCT No.: PCT/NZ2019/050018
§ 371 (c)(1),
(2) Date: Aug. 27, 2020

(87) PCT Pub. No.: WO2019/168414
PCT Pub. Date: Sep. 6, 2019

(65) Prior Publication Data

US 2021/0000259 A1 Jan. 7, 2021

(30) Foreign Application Priority Data

Feb. 27, 2018 (AU) ..... 2018900629

(51) Int. Cl.
*A47C 7/14* (2006.01)
*A61G 5/12* (2006.01)
(Continued)

(52) U.S. Cl.
CPC ..... *A47C 7/144* (2018.08); *A47C 7/021* (2013.01); *A47C 7/18* (2013.01); *A61G 5/1045* (2016.11);
(Continued)

(58) Field of Classification Search
None
See application file for complete search history.

(56) References Cited

U.S. PATENT DOCUMENTS 3,730,177 A * 5/1973 Thum ..... A61F 5/0193 602/24
4,456,247 A * 6/1984 Ehrenfried ..... A61H 1/0244 482/136
(Continued)

FOREIGN PATENT DOCUMENTS

DE 102005014637 B3 * 6/2006 ..... A61G 5/12
EP 0027063 A1 * 4/1981
(Continued)

OTHER PUBLICATIONS

Canadian Examination Report in Application 3092069, dated Oct. 14, 2021, 5 pages.
(Continued)

*Primary Examiner* — David E Allred
(74) *Attorney, Agent, or Firm* — Merchant & Gould P.C.

(57) ABSTRACT

The invention provides a customizable seating support for a seat base that is particularly useful for supporting a physically disabled person in a chair, such as a wheelchair. The seating support includes a posterior portion and a pair of thigh supports that are connected to the posterior portion, via a multi-directional connection, so that the position of at least one thigh support is independently adjustable to tilt upwardly or downwardly or to pivot outwardly relative to the posterior portion to an abducted position. In some
(Continued)

embodiments, at least one of the thigh supports may be configured to pivot inwardly relative to the posterior portion to an adducted position.

14 Claims, 24 Drawing Sheets

(51) Int. Cl.
*A61G 5/10* (2006.01)
*A47C 7/02* (2006.01)
*A47C 7/18* (2006.01)

(52) U.S. Cl.
CPC ..... *A61G 5/1059* (2013.01); *A61G 5/1091* (2016.11); *A61G 5/124* (2016.11)

(56) References Cited

U.S. PATENT DOCUMENTS 4,522,447 A * 6/1985 Snyder ..... A47C 7/18 297/452.32
4,647,040 A * 3/1987 Ehrenfried ..... A61H 1/02 482/131
4,673,216 A 6/1987 Alfer
4,844,453 A * 7/1989 Hestilow ..... A61H 1/0244 482/131
5,137,333 A * 8/1992 Chee ..... A47C 3/16 5/652
5,137,504 A * 8/1992 Mangini ..... A61H 1/0244 482/133
5,165,130 A * 11/1992 Wendling ..... A47D 13/08 5/655
5,352,023 A 10/1994 Jay et al.
5,367,730 A * 11/1994 Sher ..... A47D 13/08 5/655
5,421,801 A * 6/1995 Davies, III ..... A61H 1/0244 482/133
5,562,578 A * 10/1996 Guillemette ..... A63B 23/0488 482/136
5,645,079 A * 7/1997 Zahiri ..... A61F 5/3769 5/624
5,797,155 A * 8/1998 Maier ..... A61G 5/1054 297/284.6
5,904,641 A * 5/1999 Huang ..... A61H 1/0244 482/133
5,941,599 A * 8/1999 Roberts ..... A47C 27/086 297/181
6,036,271 A * 3/2000 Wilkinson ..... A61G 5/1043 297/284.3
6,581,227 B1 * 6/2003 Obermaier ..... A47C 7/142 5/653
7,014,602 B2 * 3/2006 Yamauchi ..... A61H 1/0218 482/79
7,108,645 B2 * 9/2006 Lincoln ..... A63B 23/0488 482/142
8,491,506 B2 * 7/2013 Smyrk ..... A63B 23/1281 601/24
9,021,637 B1 * 5/2015 Whelan ..... A61G 7/057 297/452.41
9,248,330 B1 * 2/2016 Ghanem ..... A63B 23/0488
9,560,915 B2 * 2/2017 Graller ..... A61G 5/1045
9,814,411 B2 * 11/2017 Branch ..... A61B 5/4585
10,603,239 B2 * 3/2020 Keepers ..... A61H 1/0244
2003/0205920 A1 * 11/2003 Sprouse, II ..... A47C 27/10 297/452.41
2004/0195898 A1 10/2004 Barret
2007/0102968 A1 * 5/2007 Pearse ..... A47C 7/144 297/158.1
2009/0243348 A1 * 10/2009 Toso ..... A47C 7/503 297/68
2010/0179605 A1 * 7/2010 Branch ..... A61B 17/154 606/86 R
2012/0017375 A1 1/2012 Weibel et al.
2012/0040402 A1 2/2012 Saha
2012/0124749 A1 * 5/2012 Lewman ..... A47C 15/004 5/653
2013/0112827 A1 * 5/2013 Holstad ..... A61G 5/12 248/229.2
2014/0130260 A1 * 5/2014 Kreuzer ..... A61G 13/1295 5/624
2014/0223666 A1 * 8/2014 Pavlin ..... A61G 5/1048 297/229
2014/0306504 A1 * 10/2014 Boy ..... B60N 2/0224 297/313
2014/0345060 A1 * 11/2014 Ribble ..... A61B 5/6892 5/706
2015/0101125 A1 * 4/2015 Fang ..... A47D 13/08 5/655
2016/0353892 A1 * 12/2016 James ..... A47C 3/16
2018/0199728 A1 * 7/2018 Leng ..... A47C 27/0456
2019/0125609 A1 * 5/2019 Mason ..... A47C 9/025
2020/0047649 A1 * 2/2020 Takahashi ..... B29C 44/08
2021/0106144 A1 * 4/2021 Wornell ..... A47C 7/021
2021/0282559 A1 * 9/2021 Towle ..... A47C 3/16

FOREIGN PATENT DOCUMENTS

FR 2711058 A1 4/1995
FR 3020268 10/2015
GB 1343850 A * 1/1974
WO 9806303 2/1998
WO 2002/071997 A1 9/2002
WO 2003/063650 A1 8/2003
WO 2015/162391 10/2015

OTHER PUBLICATIONS

European Search Report for EP Application No. 19 76 0880 dated Feb. 26, 2021 (10 pages).
International Search Report for International Application No. PCT/NZ2019/050018 dated May 16, 2019 (4 pages).
International Written Opinion for International Application No. PCT/NZ2019/050018 dated May 16, 2019 (9 pages).
PCT International Preliminary Report on Patentability in Application PCT/NZ2019/050018, dated Sep. 3, 2020, 11 pages.

* cited by examiner

SEATING SUPPORT

This application is a National Stage Application of PCT/NZ2019/050018, filed 26 Feb. 2019, which claims benefit of Serial No. 2018900629, filed 27 Feb. 2018 in Australia and which application are incorporated herein by reference. To the extent appropriate, a claim of priority is made to each of the above disclosed applications.

FIELD OF INVENTION

This invention relates to a seating support for a seat base that comprises a pair of thigh supports that are configured to be manipulated into different positions to provide customised thigh support for a user of the seat base.

BACKGROUND

Seating occupants, and in particular, wheelchair occupants may be required to be seated for extended periods. It is important that in a seat for physically disabled occupants, such as a wheelchair, the seat provides sufficient support to assist the occupant to sit comfortably in the seat and to remain safe in the seat without causing the seat to tip over. People with severe physical disabilities may require specialized support and equipment to help them sit safely and comfortably upright in a seat/chair, such as a wheelchair, dining chair, lounge chair and so on.

People with physical disabilities often have different support requirements for seats and these requirements may change over time. It is therefore helpful if seating can be customised to meet the requirements of individual chair users, especially people who may also require specialized seating to assist with their positioning in a wheelchair or other form of chair or seat.

It is known to provide contoured seat bases for wheelchairs. These seat bases often include thigh channels, which are parallel, horizontal channel-like depressions that extend in a direction from the rear to the front of the seat base. Each thigh channel is dimensioned to receive an occupant's thigh. The thigh channels may offer positioning support to the user by substantially holding the user's thighs in each channel to help prevent the occupant's legs from falling into an uncomfortable or undesirable position that is detrimental to the user's posture and safety in the seat.

However, known thigh channels are of a fixed position extending horizontally in a direction between the front and rear of the seat base. Although this may suit many occupants, such an arrangement does not suit all occupants, especially people with severe physical disabilities. These people are referred to in this specification as high needs occupants of customised seating. Such occupants may have cerebral palsy, multiple sclerosis, or acquired brain injury (such as near-drowning) for example and may be permanently wheelchair bound. Such occupants are not usually ambulant and face risk of postural deterioration sometimes known as postural molding or malalignment. For these people, it may not be possible to locate their legs comfortably or safely on a seat base having conventional thigh channels. Instead, a customised seat base may be required to be manufactured specifically for the thigh support needs of the person using the seat base. Such seat bases are typically expensive and the thigh channels are in a fixed position, which means that the seat base might become unsuitable if the person's physical needs change over time, such as if their disability improves or worsens or if the person is a growing child.

FIGS. 1 and 2 demonstrate the different support needs of two different people with severe physical disabilities. FIG. 1 shows a person whose right leg is externally rotated and abducted from the hips and whose left leg extends forward from the body and downwards due to muscle tightness and contractures. The person's left hip has a substantial obliquity. FIG. 2 shows a person whose thighs cannot extend at right angles to the torso. Instead, the thighs extend downwardly, forming an angle of greater than 90° between the torso and the thighs. In other words, the person's legs are internally rotated from the hips and not in neutral alignment. The legs also suffer from muscle tightness and contractures. Because of their physical alignment, neither of the people in FIGS. 1 and 2 are able to sit comfortably and stably in known chairs having fixed parallel, horizontal leg channels that extend in a direction from the front to the rear of the seat.

There is therefore a need to provide a customizable seating support for a seat base, the seating support being configured to support the thighs of a physically disabled user and to allow thigh supports of the seating support to be positioned independently from each other.

It is an object of the present invention to go at least some way toward addressing this need or to at least provide the public with a useful alternative.

SUMMARY OF INVENTION

In a first aspect, the invention provides a seating support for a seat base, the seating support comprising a posterior portion, a first thigh support and a second thigh support, wherein each thigh support is connected to the posterior portion via a multi-directional connection and wherein the position of the at least one thigh support is independently adjustable to tilt upwardly or downwardly or to pivot outwardly relative to the posterior portion.

In one form, both thigh supports are connected to the posterior portion via the multi-directional and are adjustable to tilt upwardly or downwardly or to pivot outwardly relative to the posterior portion.

Optionally, both thigh supports are adjustable to tilt upwardly and downwardly and to pivot outwardly relative to the posterior portion.

Preferably, each thigh support is also able to pivot inwardly relative to the posterior portion by pivoting about the multi-directional connection.

In one form, the multi-directional connection is a flexible connection that allows the respective thigh support to rotate about an x-axis and the y-axis passing through the flexible connection.

In one form, each thigh support comprises a front, a rear, an upper part and a lower part; wherein the upper part connects the thigh support to the posterior portion via the multi-directional connection.

The lower part is preferably attachable to and detachable from the upper part of the thigh support.

Preferably, the upper part comprises an upper surface and a lower surface, and wherein the lower surface is inclined upwardly toward the front of the thigh support.

In one form the upper part comprises a support section and a removable base section.

In one form, the support section comprises a lower surface, a portion of which is inclined upwardly toward the front of the thigh support and wherein the removable base section comprises a lower surface and is removably located beneath the support section so that the lower surface of the removable base section and the inclined portion of the lower surface of the support section form a generally contiguous lower surface of the upper part that is inclined upwardly toward the front of the thigh support.

Preferably, the removable base section is wedge shaped.

In one form, the lower part comprises one or more removable angle adjustment members.

Preferably, each angle adjustment member comprises an upper surface that is inclined toward the front of the respective thigh support.

In one form, each angle adjustment member is removably located beneath the upper part and the inclined upper surface of each angle adjustment member is inclined upwardy toward the front of the thigh support at an angle that is generally equivalent to the angle of incline of the lower surface of the upper part.

Preferably, each angle adjustment member is wedge shaped. In one form, the lower part comprises two angle adjustment members.

Preferably, the upper part and the lower part are detachably attachable via one or more fasteners.

In one form, the support section and the base section are detachably attachable via one or more fasteners.

Preferably, the upper part and at least one of the angle adjustment members are detachably attachable via one or more fasteners.

In one form, the lower part comprises at least two angle adjustment members that are detachably attachable via one or more fasteners.

In one form, an insert is detachably attachable to at least one of the angle adjustment members via one or more fasteners. Optionally, the fasteners comprise hook and loop fasteners. Preferably, the insert is wedge shaped. In one for, the insert consists of one of the angle adjustment members of the other thigh support after being detached from the lower part of the other thigh support.

In one form, the posterior portion of the seating support comprises a posterior support that is connected to each thigh supports via one of the flexible connections, and the posterior portion also comprises one or more removable height adjustment members. Each of the height adjustment members may comprise a height adjustment layer that is removably located beneath the posterior support.

In one form, the posterior portion comprises one or more removable obliquity members located below the posterior support and along opposing side regions of the posterior support. The posterior portion optionally comprises an upper surface having a raised profile at a central front region of the posterior portion. In one form, the posterior portion comprises an upper surface comprising a depression located in a central region of the upper surface.

In one form, each thigh support comprises an upper surface comprising an elongate depression that forms a leg well extending in a direction from front to rear of the thigh support, each leg well being configured to receive and locate an occupant's thigh on the thigh support.

Optionally, the seating support is made from a material comprising medium or high density foam.

The seating support may also comprise a flexible cushioning overlay located on an upper surface of the seating support. The cushioning overlay may comprise a slit extending from a front edge of the cushioning overlay to a central region of the cushioning overlay, the slit defining a posterior region of the cushioning overlay located above the posterior portion of the seating support, and a pair of side regions, each side region being located above one of the thigh supports. Preferably, the cushioning overlay is attached to the upper surface of the seating support and substantially adopts the contours of the upper surface of the seating support. Optionally, the cushioning overlay comprises a low or medium density foam.

In one form, the seating support also comprises a cover comprising an elasticated material that encases the seating support.

In a second aspect, the invention provides a method of customizing the seating support of the invention to suit the needs of an occupant. The method comprises the step of removing at least one of the angle adjustment members of the lower part of the first thigh support to tilt the first thigh support downwardly relative to the posterior portion of the seating support. Optionally, the method further comprises the step of removing at least one of the angle adjustment members of the lower part of the second thigh support. In one form, the method also comprises the step of inserting the removed angle adjustment member to a position beneath the upper part of the second thigh support.

In a third aspect, the invention provides a method of customizing the seating support of the invention to suit the needs of an occupant by locating an insert beneath the upper part of the first thigh support to tilt the first thigh support upwardly relative to the posterior portion of the seating support.

In a fourth aspect, the invention provides a method of customizing the seating support of the invention to suit the needs of an occupant by pivoting at least one thigh support about its respective multi-directional connection to adopt an internally or externally rotated position. Preferably, the steps of externally rotating one or both thigh supports about the flexible connection to an externally rotated position is followed by the step of inserting at least one abduction insert between the thigh supports to hold the thigh supports in the externally rotated position.

Also disclosed herein is a seating support for a seat base. The seating support comprises a posterior portion, a first thigh support and a second thigh support. At least one of the thigh supports is connected to the posterior portion via a flexible connection. The position of the at least one thigh support is adjustable to tilt upwardly or downwardly or to pivot outwardly relative to the posterior portion.

In a preferred form, both thigh supports are connected to the posterior portion via a flexible connection and are adjustable to tilt upwardly or downwardly or to pivot outwardly relative to the posterior portion. More preferably, both thigh supports are adjustable to tilt upwardly and downwardly and to pivot outwardly relative to the posterior portion.

In one form, at least one of the thigh supports is comprised of two parts: an upper part and a lower part. The upper part may be connected to the posterior portion via the flexible connection and the lower part is attachable to and detachable from the upper part of the thigh support.

The upper part or lower part or both the upper and lower parts may comprise one or more fasteners for attaching the upper and lower parts together. The fasteners may comprise hook and loop fasteners. Preferably, hook or loop fasteners are located on a lower surface of the upper part and complementary loop or hook fasteners are located on an upper surface of the lower part of the thigh support.

In one form, a lower surface of the lower part also comprises fasteners to attach to an upper surface of an insert to stack the upper and lower parts on top of the insert. Preferably, the insert is wedge-shaped. Optionally, the insert consists of the lower part of the other thigh support after being detached from the upper part of the other thigh support.

In a preferred form, the lower part of one or both thigh supports comprises a front region for locating at or near the front of the thigh support and a rear region for locating at or near the rear of the thigh support. The front region may have a greater thickness than the rear region. Preferably, the lower part is wedge shaped.

In one form, the upper part of one or both thigh supports comprises a front region for locating at or near the front of the thigh support and a rear region for locating at or near the rear of the thigh support. The rear region of the upper part may have a greater thickness than the front region of the upper part. Preferably, the upper part is wedge shaped.

Optionally, the posterior portion comprises an upper surface having a raised profile at a central front region of the posterior portion. In one form, the posterior portion comprises a contoured upper surface comprising a depression located in a central region of the upper surface.

In one form, each thigh support comprises a contoured upper surface comprising a leg well extending from front to rear of the thigh support. Each leg well may be configured to receive and locate an occupant's thigh on the thigh support.

The seating support may be made from a material comprising medium or high density foam.

The seating support may also comprise a flexible cushioning overlay located on an upper surface of the seating support. The cushioning overlay may comprise a slit extending from a front edge of the cushioning overlay to a central region of the cushioning overlay. The slit defines a posterior region of the cushioning overlay located above the posterior portion of the seating support, and a pair of opposing side regions, each side region being located above a respective thigh support and adjacent the slot. Preferably, the cushioning overlay is attached to the upper surface of the seating support and substantially adopts the contours of the upper surface of the seating support. In one form, the cushioning overlay may be attached to the seating support by adhesive or hook and loop fasteners. The cushioning overlay preferably comprises a low or medium density foam.

The seating support may also comprise a cover that encases the seating support. The cover may comprise an elasticated material.

Also disclosed herein is a method of customizing the seating support of the first aspect of the invention to suit the needs of an occupant, the method comprising the step of: removing the lower part of the first thigh support to tilt the first thigh support downwardly relative to the posterior portion of the seating support. Optionally, the method may further comprise the step of removing the lower part of the second thigh support. The method may also comprise the step of locating the removed lower part to a position beneath the upper part of the second thigh support.

Also disclosed herein is a method of customizing the seating support of the first aspect of the invention to suit the needs of an occupant, the method comprising the step of: pivoting at least one thigh support about its respective flexible connection to adopt an internally or externally rotated position.

In one form, the method further comprises the step of externally rotating both thigh supports about the flexible connections to space the thigh supports farther apart at the front of the seating support.

In another form, the method comprises the step of internally rotating one thigh support about the respective flexible connection and externally rotating the other thigh support about the respective flexible connection.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

Reference to any prior art in this specification is not, and should not be taken as, an acknowledgement or any form of suggestion that prior art forms part of the common general knowledge in the field of endeavour in any country in the world.

The invention consists in the foregoing and also envisages constructions of which the following gives examples only.

BRIEF DESCRIPTION OF THE DRAWINGS

Preferred forms of the invention will now be described by way of example and with reference to the accompanying drawings, in which.

DETAILED DESCRIPTION

The invention is further described with reference to the following examples. It will be appreciated that the invention as claimed is not intended to be limited in any way by these examples.

As exemplified by embodiments shown in FIGS. 3 to 32, the present invention relates to a customizable seating support 100 for a seat base. The seating support is particularly useful for supporting a physically disabled person in a chair, such as a wheelchair.

Figure 1:
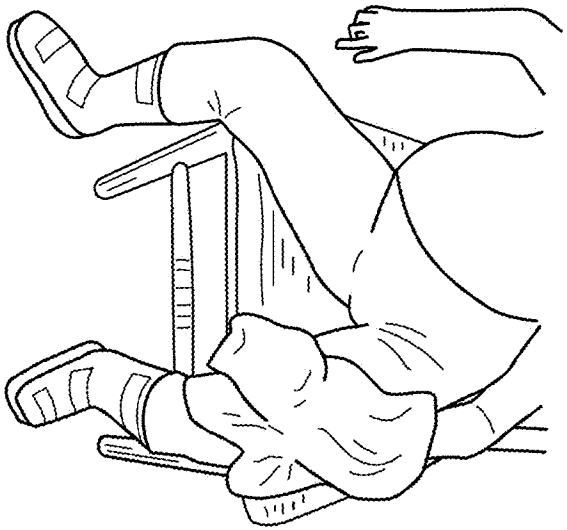
FIG. 1 shows a person with asymmetrical pelvic alignment and an abducted/externally rotated right thigh.
Figure 2:
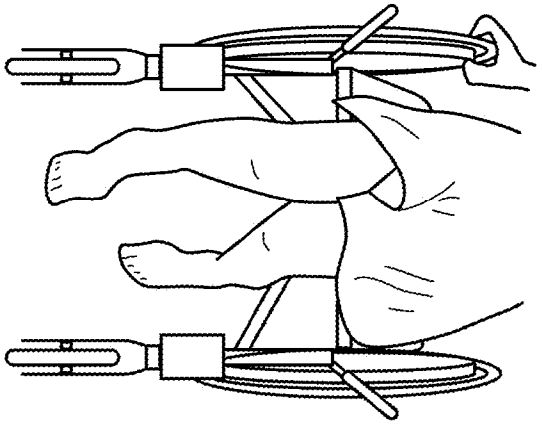
FIG. 2 shows a person with asymmetrical pelvic alignment and an abducted/internally downwardly projecting thighs.
Figure 3:
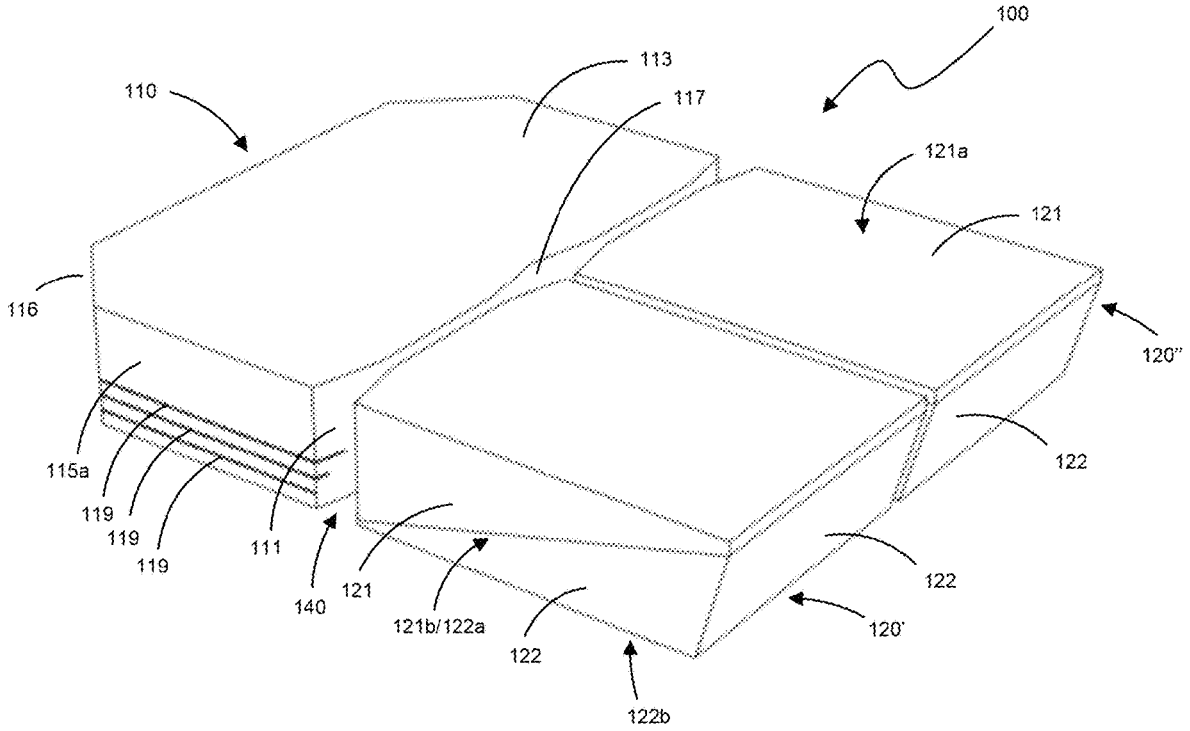
FIG. 3 shows a schematic isometric view of one form of seating support according to the invention, in which the upper and lower parts of each thigh support are attached together and the thigh supports are in a neutral position, in which the thigh supports lie substantially parallel to each other and facing toward the front of the seat.
Figure 4:
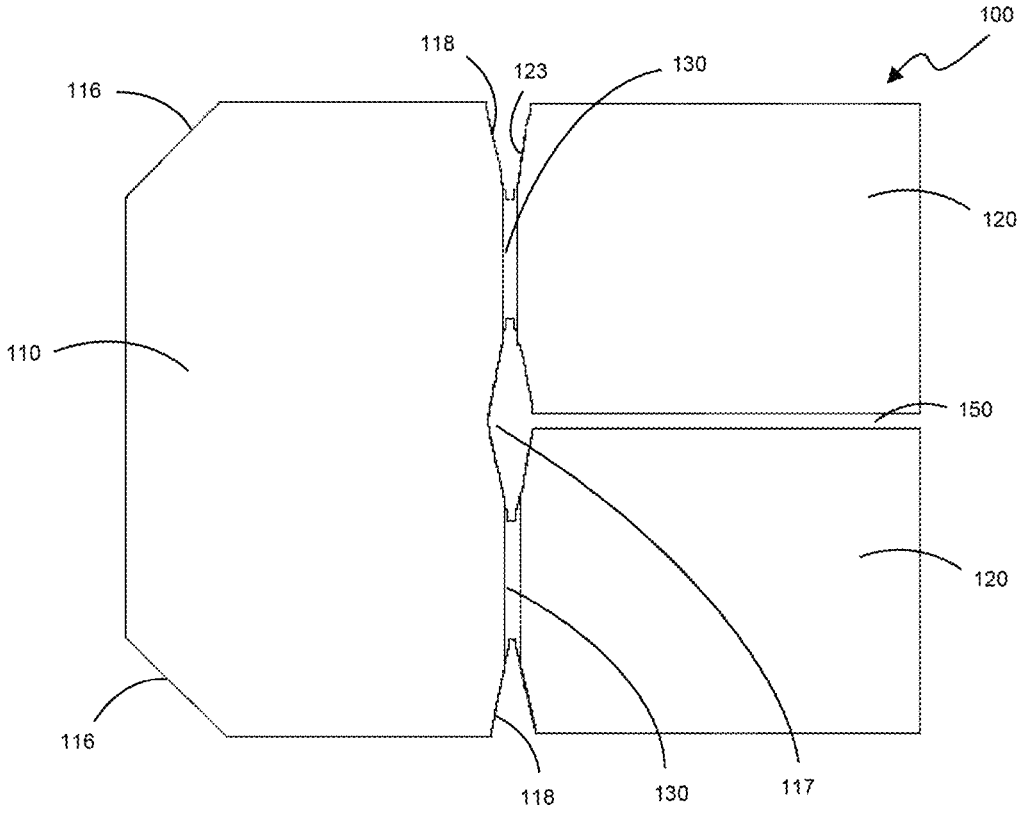
FIG. 4 is a top view of the seating support of FIG. 3.

As shown in FIGS. 3 and 4, the seating support 100 comprises a posterior portion 110 that is located at or near the rear of the seating support 100. In use, an occupant's posterior would be positioned on the posterior portion 110. The posterior portion preferably comprises a posterior support 110*a* and one or more removable height adjustment members, which are typically configured to be located beneath the posterior support, to adjust the height of the posterior support.

The seating support 100 also comprises a pair of first and second thigh supports 120', 120" that are independently adjustable to adjust the angle and direction of the thigh supports vertically and to adjust the direction of the thigh supports horizontally. In effect, the thigh supports 120 are configured to be moved independently of each other by rotating about the x- and y-axes via a multi-directional connection 130 with the posterior portion 110.

Each thigh support comprises a front, a rear, an upper part and a lower part that is attachable and detachable from the upper part.

Figure 4A:
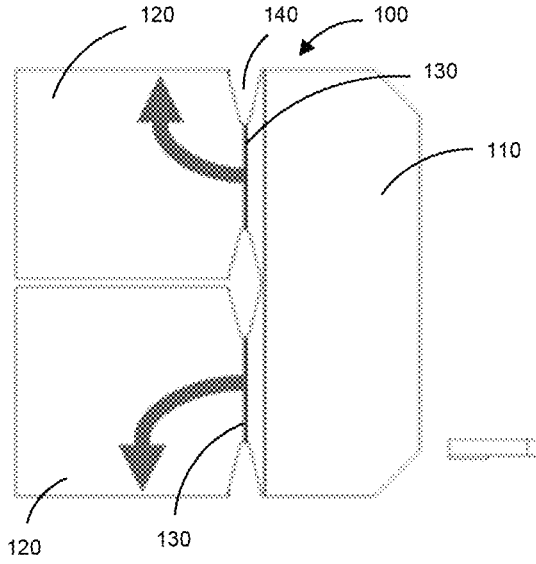
FIG. 4*a* is a schematic plan view showing the direction of external rotation of the thigh supports of the seating support.
Figure 4B:
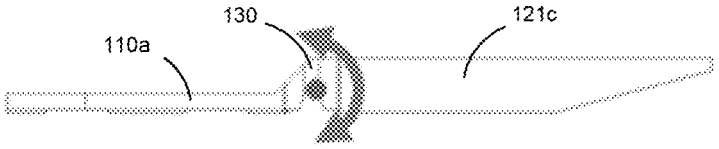
FIG. 4*b* is a schematic plan view showing the direction of vertical rotation of the thigh supports of the seating support.
Figure 5:
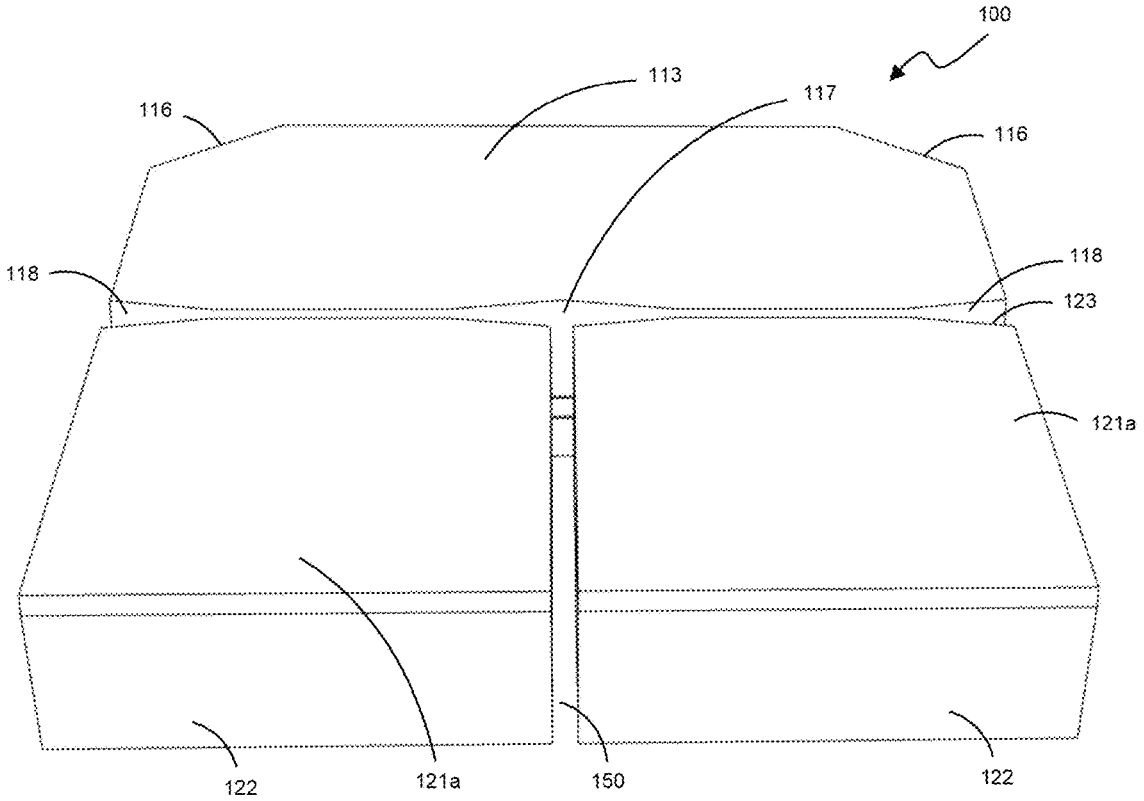
FIG. 5 is a front perspective view of the seating support of FIG. 1.
Figure 27A:
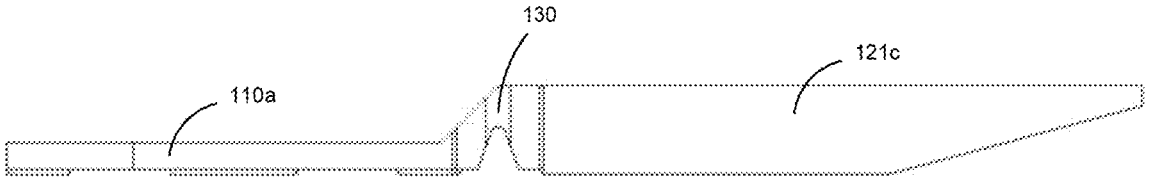
FIG. 27*a* is a side view of one form of core of the seating support, the core comprising a posterior portion, a support section of a two part thigh support and a multi-directional connection, being formed together as a single part.
Figure 27B:
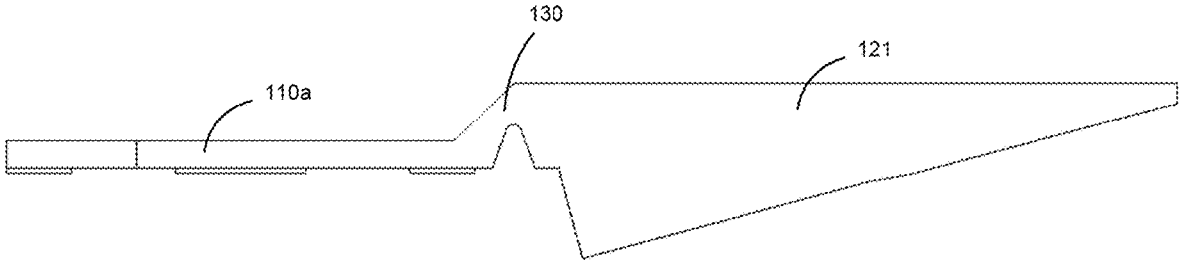
FIG. 27*b* is a side view of another form of core of the seating support, the core comprising a posterior portion, an upper part of the thigh support that comprises a single part, and a multi-directional connection, being formed together as a single part.
Figure 27C:
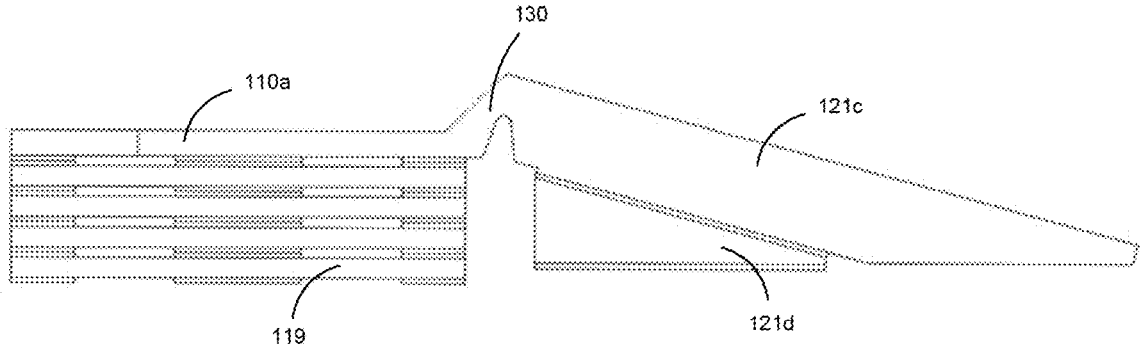
FIG. 27*c* is a side view of a core of the seating support, comprising a posterior portion, a support section of the thigh support and a multi-directional connection formed as a single part to which height adjustment members have been added to the posterior portion and a base section is located beneath the support section of the thigh support.
Figure 28:
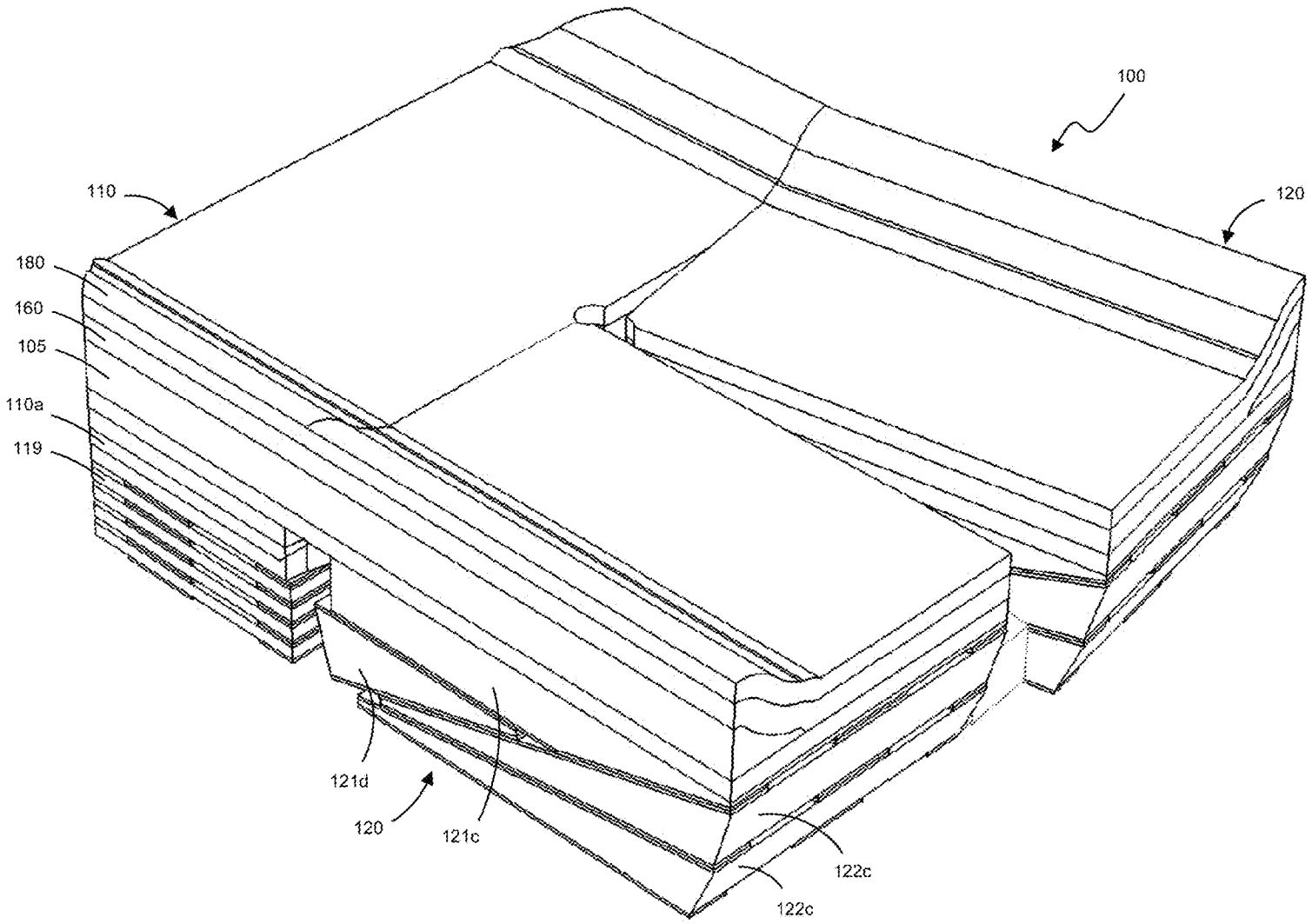
FIG. 28 is an isometric view of the seating support of FIG. 23 in which one of the thigh supports is externally rotated.
Figure 29:
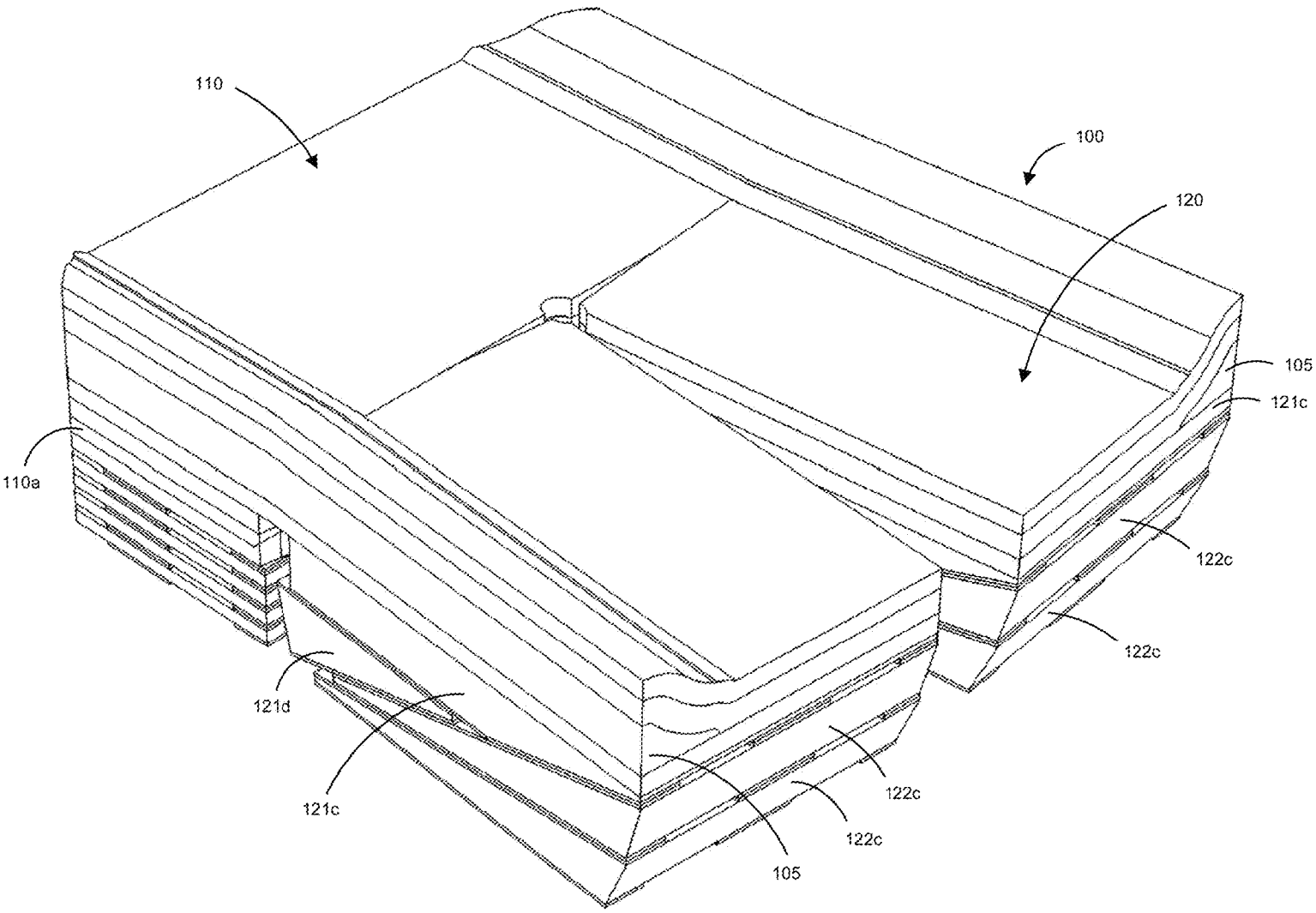
FIG. 29 is an isometric view of the seating support of FIG. 23 in which both thigh supports are externally rotated.

One or each thigh support 120 is connected to the posterior portion 110 by a multidirectional connection, such as a flexible connection/flexible connector 130. The flexible connection may be a flexible hinge that allows some degree of lateral flexion of the side supports, as shown in FIG. 4*a* and may also allow some degree of vertical flexion, such as by hinging each thigh support upwardly and downwardly, as shown in FIG. 4*b*. Preferably, both thigh supports 120', 120" are connected to the posterior portion 110 by a flexible connection 130/flexible connector, as shown in FIG. 4, which connects the upper part of each thigh support to the posterior support of the posterior portion. Each flexible connection 130 allows the respective thigh support 120 to be tilted upwardly or downwardly relative to the posterior portion 110 and/or to rotate externally/outwardly sideways in an abducting arrangement relative to the posterior portion. In one form, each flexible connection 130 also allows the respective thigh support 120 to rotate internally/inwardly sideways in an adducting arrangement relative to the posterior portion. In one form, viewed from one side as shown in FIGS. 27*a* to 27*c*, the posterior support, the multi-directional connection and the upper part of the thigh support may be integrally formed as a single part to form a core of the seating support. For example, the core may be made of foam and the multi-directional connection may be a flexible connection defined by a v-notch formed in the lower surface of the seating support 100 and a v-notch formed in the upper surface of the seating support.

Optionally, the posterior portion includes shaped rear corner sections 116 to enable the seating support to fit easily onto a seat base in a chair, such as a wheelchair, or lounge chair for example. In one form, the rear corner sections 116 of the posterior portion may be curved. In another form, the rear corner sections 116 may be clipped on the diagonal, as shown in FIGS. 3 and 4.

The posterior portion 110 comprises a front surface 111, a rear surface 112, a top surface 113, a bottom surface 114 and side surfaces 115*a*, 115*b*. Side regions of the posterior support are located near the side surfaces 115*a*, 115*b*. The front surface 111 faces the front of the seating support 100 and the rear surface 112 faces the rear of the seating support 100. Optionally, a recessed region 117 or channel, such as a generally v-shaped channel, is provided at a central region of the front surface 111 of the posterior portion. The recessed region 117 is typically positioned at the midpoint between the thigh supports 120 and the flexible connections 130. Rear inner corner regions of each thigh support 120 may also include recessed/cut-away portions that may be curved or angled. Preferably, the cut-away portions are angled to form a diamond shaped opening with the recessed region 117. The diamond shaped opening allows the posterior portion and thigh supports to flare inwards, such as if one thigh support was adducted/angled inwardly.

Optionally, the front surface 111 of the posterior portion may also include cutaway portions 118 at the near the sides 115 of the posterior portion, so that the front surface 111 tapers rearwardly toward the sides 115*a*, 115*b* of the posterior portion 110, as shown in FIGS. 3 and 4. The tapered sides at the front of the posterior portion 110 help the posterior portion and thigh supports 120 to compress and deform in a substantially controlled manner, when an occupant sits on the seating support 100, to provide greater comfort and stability to the occupant.

Optionally, the upper surface of the posterior portion has a raised profile at a central front region of the posterior portion. In one form, a depression may be formed in a central region of the upper surface of the posterior portion so that the side regions at least partially curve or angle around the posterior of an occupant of the seating support. This arrangement tends to be more comfortable and may offer greater support to many occupants.

Figure 8:
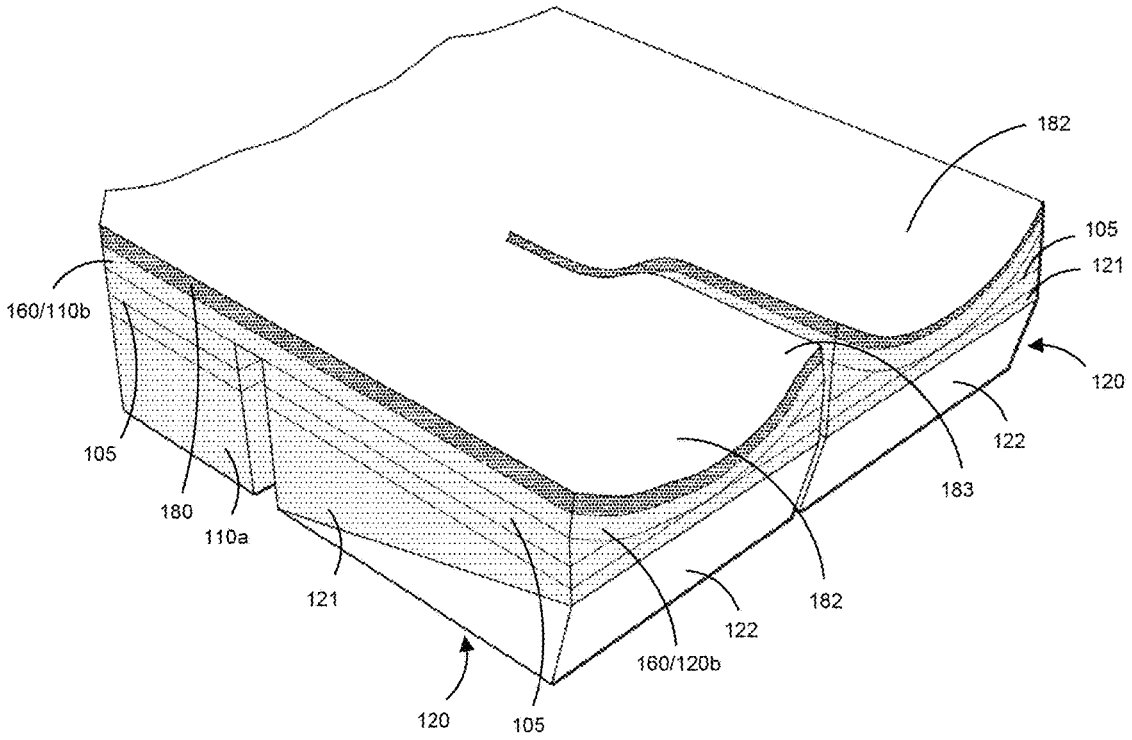
FIG. 8 is a front perspective view of the seating support of FIG. 1 in a neutral position and further comprising a cushioning overlay on the upper surface of the support.

In one form, the seating support 100 comprises a contouring layer 160 that sits above the both the posterior portion and thigh supports. In other forms, the seating support may comprise independent contouring layers 110*b*, 120*b* for the posterior portion 110*a* and thigh supports 120 respectively. In one form, as shown in FIG. 8, the posterior portion 110 comprises a posterior support/base 110*a* that is attached to each thigh support 120 via at least one multi-directional connection 130, such as a flexible connection, as described above, and further comprises a contouring layer 110*b*/160 positioned on an upper surface of the posterior support 110*a*. The contouring layer 160 comprises an upper surface having a central region in which a depression is formed so that the side and rear regions of the contouring layer 110*b*/160 curve or angle upwardly around the central depression to help centre and support an occupant on the seating support 100.

The contouring layer 110*b*/160 may rest on the posterior support 110*a* or may be removably attached to the posterior support, such as by the use of hook and loop fasteners or domes, or the contouring layer 110*b*/160 may be adhered or welded to the posterior support 110*a*, particularly if the contouring layer 110*b*/160 and posterior support 110*a* are formed of foam.

Figure 10:
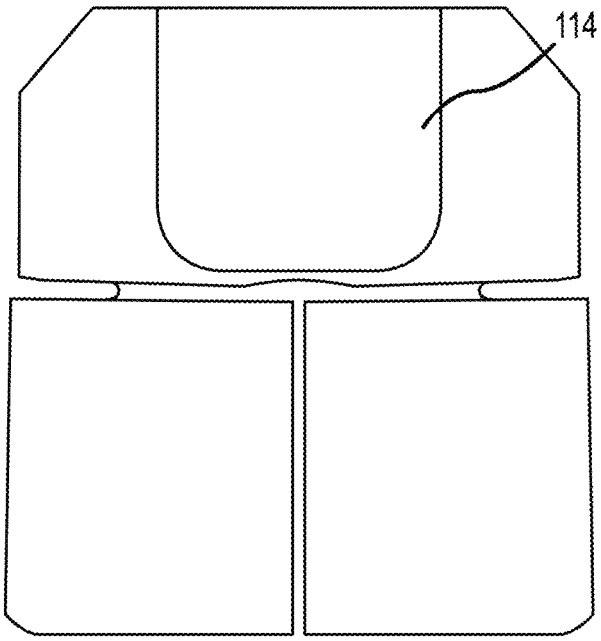
FIG. 10 is a bottom view of the seating support of FIG. 8.

In one form, as shown in FIG. 10, the bottom surface 114 of the posterior portion 110 may be generally flat. In another form, the bottom surface 114 of the posterior portion may comprise a generally flat central region and may also comprise side and rear regions that taper upwardly in a curved or angled arrangement. This configuration helps the seating support to remain balanced when placed on a shaped or cushioned seat base.

In one form, as shown in FIGS. 23 to 31, the posterior portion comprises one or more removable height adjustment members 119. In one form, the height adjustment members are configured to be located beneath the posterior support 110*a* and can be stacked on top of each other to a selected height or removed to provide the posterior portion with the desired height to meet the user's needs. In another form, the height adjustment members 119 are locatable and stackable on top of the posterior support 110*a*. Preferably, each adjustment member comprises a stackable layer of material that can be selectively added to or removed from the posterior portion to adjust the height of the posterior portion. The stackable height adjustment members 119 may be configured to detachably attach to each other and to the posterior support via one or more fasteners, such as domes, zippers, or hook and loop fasteners for example.

Figure 6:
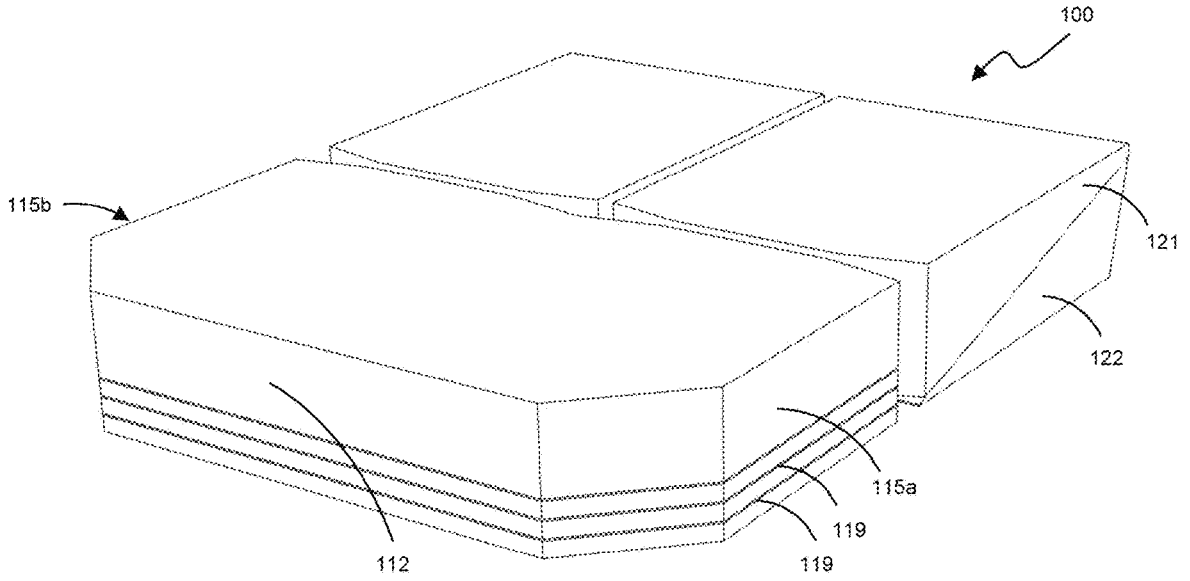
FIG. 6 is a rear perspective view of the seating support of FIG. 1.
Figure 7:
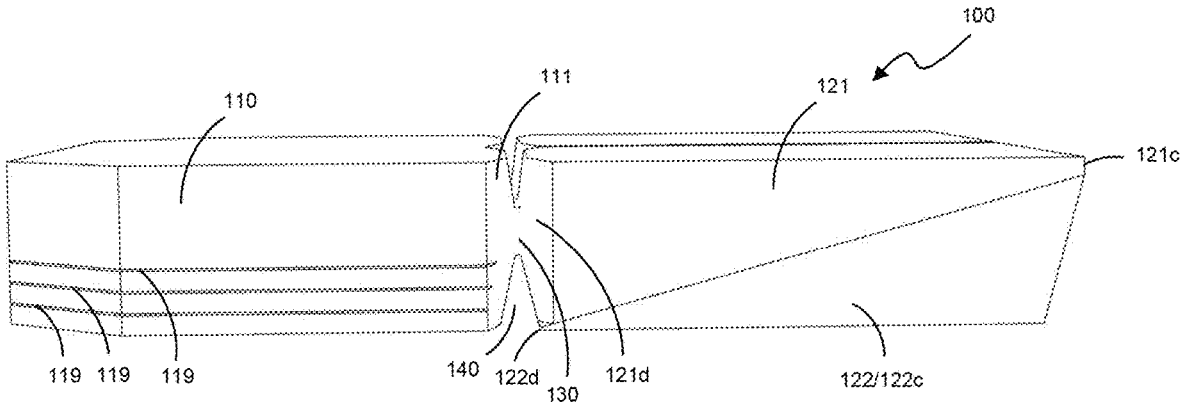
FIG. 7 is a side perspective view of the seating support of FIG. 1.

In one form, as shown in FIGS. 3, 6, and 7, one or more removable obliquity members 105 may be located beneath the posterior support and may be positioned along one or both side regions and/or the rear of the posterior portion. These members may be firm or soft, but are preferably padded to provide an element of softness. In one form, the obliquity members may be elongate shims or wedges. The obliquity members 105 can be removed from or added to the posterior portion to customize the posterior portion to suit the pelvic support requirements of the occupant. The removable obliquity members can either increase or decrease the height of the posterior portion at the rear and/or one or both side regions of the posterior portion. By using more obliquity members on one side region of the posterior portion than on the other side region, it is possible to create an asymmetrical posterior portion 110*a* of the seating support to assist the postural support and stability of a user having asymmetrical postural alignment.

Each of the thigh supports 120 are spaced from the front surface 111 of the posterior portion 110 to form a first gap 140 between the posterior portion and thigh supports 120. The flexible connections 130 are provided in the gap 140 and connect the posterior portion 110 to the thigh supports 120. Typically each thigh support 120 is connected to the posterior portion 110 via a single multi-directional connection, such as a flexible connection 130, as shown in FIGS. 4 and 7. The single connection/connector is preferably located generally centrally on the rear surface of each thigh support. In other forms, two or more multi-directional/flexible connections 130 may be used to connect each thigh support 120 to the posterior portion 110.

Optionally, the side regions of each thigh support may include cutaway portions 123 at the rear of the thigh support, as shown in FIG. 4, to provide a side gap between the posterior portion and the thigh support on each side of the seat support 100. Each side gap provides space for the adjacent thigh support to flex/rotate outwardly to the side to an externally rotated position.

In a neutral position, the thigh supports 120 extend in a direction from the front surface 111 of the posterior portion 110 to the front of the seating support 100 in a substantially parallel arrangement, so that the thigh supports 120 lie side by side, and the upper surface of the thigh supports lies generally horizontally. Preferably, a longitudinal gap 150 is provided between the inner facing side surfaces of the thigh supports 120 to space the thigh supports slightly apart to help each support 120 move freely and independently from the other support 120.

Each thigh support 120 comprises an upper part 121 and a lower part 122. The lower part 122 comprises at least one angle adjustment member 122*a* and is removably locatable beneath the upper part 121. Each thigh support 120 may be configurable to independently adjust the tilt of the thigh support to a selected angle between an upwardly inclined position, a neutral position, and a downwardly inclined position by flexing vertically about the x-axis via the connection 130 (i.e. the seating support of the invention allows the angle of the upper surface of the thigh supports to be selectively adjusted). The thigh supports are also able to be independently adjusted to vary the horizontal direction of the thigh supports by flexing horizontally about the y-axis via the connection 130, so that one or both thigh supports project straight ahead or to an inwardly rotated or externally rotated position.

Either the upper part 121 or lower part 122 may be connected to the posterior portion 110 via one or more flexible connections 130. The other of the upper and lower parts 121, 122 of each thigh support may be attachable and detachable from the connected part 121, 122.

In one form, as shown in FIGS. 7 and 27*a* to 27*c*, the upper part 121 is connected to the posterior portion 110 via a flexible connection 130 and the lower part 122 is detachably attachable to the upper part 121 of the thigh support 120. In one form, the upper part 121 and the lower part 122 may be detachably attachable to each other via one or more fasteners. For example, the upper part 121 and at least one angle adjustment member 122*a* of the lower part may be detachably attachable to each other by one or more fasteners.

Each upper part 121 includes an upper surface 121*a* and a lower surface 121*b*. Similarly, each lower part 122 (and each angle adjustment member of the lower part) includes an upper surface 122*a* and a lower surface 122*b*. In preferred embodiments, the upper and/or lower surfaces of each of the upper and lower parts 121, 122 form upper and/or lower attachment surfaces respectively. The attachment surfaces may comprise one or more fasteners, such as domes, zippers or hook and loop fasteners, to attach the upper and lower parts together. In one form, the fasteners comprise hook and loop fasteners. For example, hook (or loop) fasteners may be located on the lower surface 121*b* of the upper part 121 and complementary loop (or hook) fasteners may be located on the upper surface 122*a* of the lower part 122 of at least one of the thigh supports 120. In this arrangement, the lower surface 121*b* of the upper part 121 may detachably attach to the upper surface 122*a* of the lower part 122. The hook and loop fasteners may be provided on one or more strips, a plurality of dots or other shapes, or generally the entire attachment surface of the upper or lower part 121, 122, as the case may be, may be covered in a layer of hooks or loops. For example, the lower surface of the upper part may generally be covered in loops and the upper surface of the lower part may generally be covered in hooks.

In another form, the attachment surfaces of one or both of the upper and lower parts 121, 122 may be textured surfaces to provide a friction engagement between the two parts 121, 122. In yet another embodiment, the attachment surfaces of one or both of the upper and lower parts 121, 122 may be tacky or may otherwise be configured to inhibit movement between the upper and lower parts 121, 122.

Figure 14:
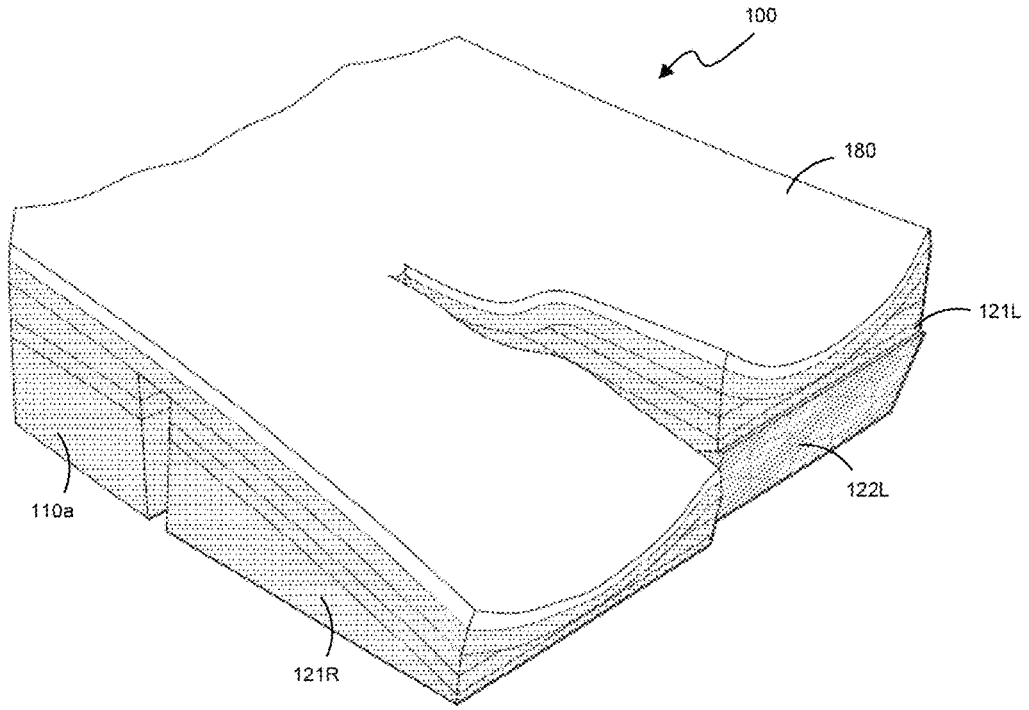
FIG. 14 is a front isometric view of the seating support of FIG. 13 after the lower part of the right thigh support has been removed to tilt the right thigh support downwardly relative to the posterior portion of the seating support.
Figure 15:
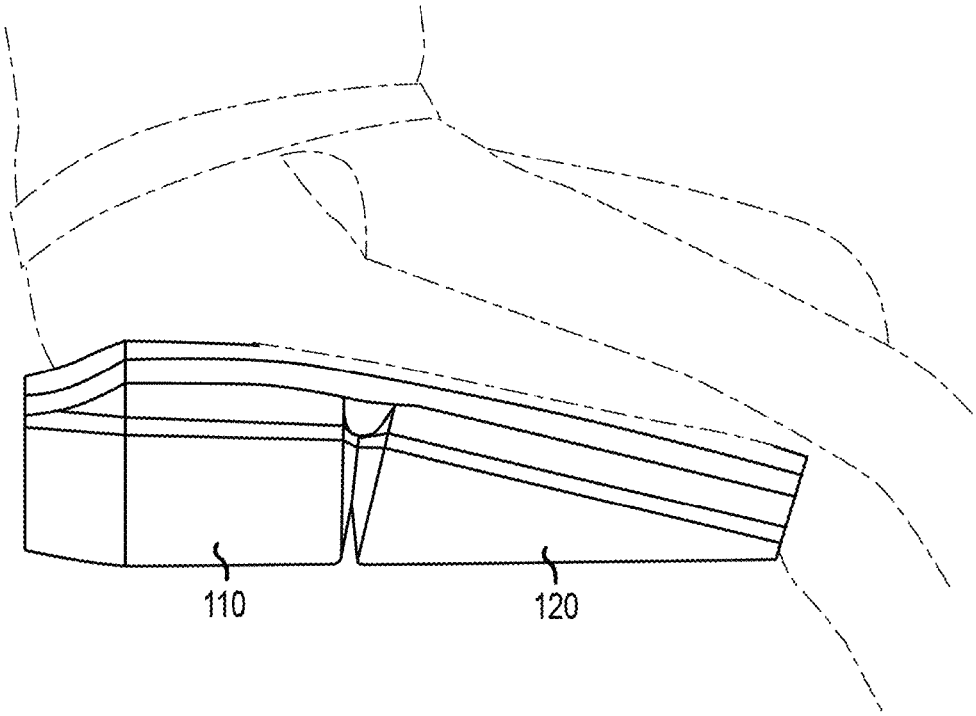
FIG. 15 is an isometric view from the side of a person sitting in the seating support of FIG. 14 where the right thigh support is tilted downwardly and the downward flexing of the right thigh support relative to the posterior portion of the seating support can be clearly seen.
Figure 16:
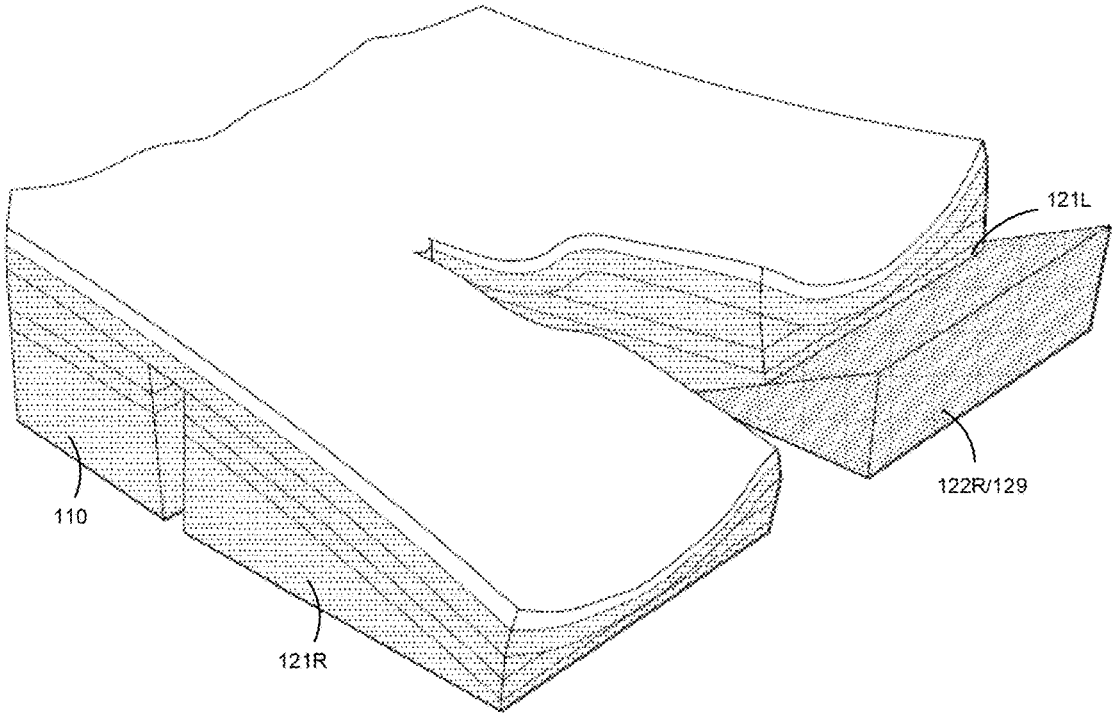
FIG. 16 is a front isometric view of the seating support of FIG. 14 where the lower part of the removed right thigh support is being inserted beneath the upper part of the left thigh support to tilt the left thigh support upwardly relative to the posterior portion of the seating support.
Figure 17:
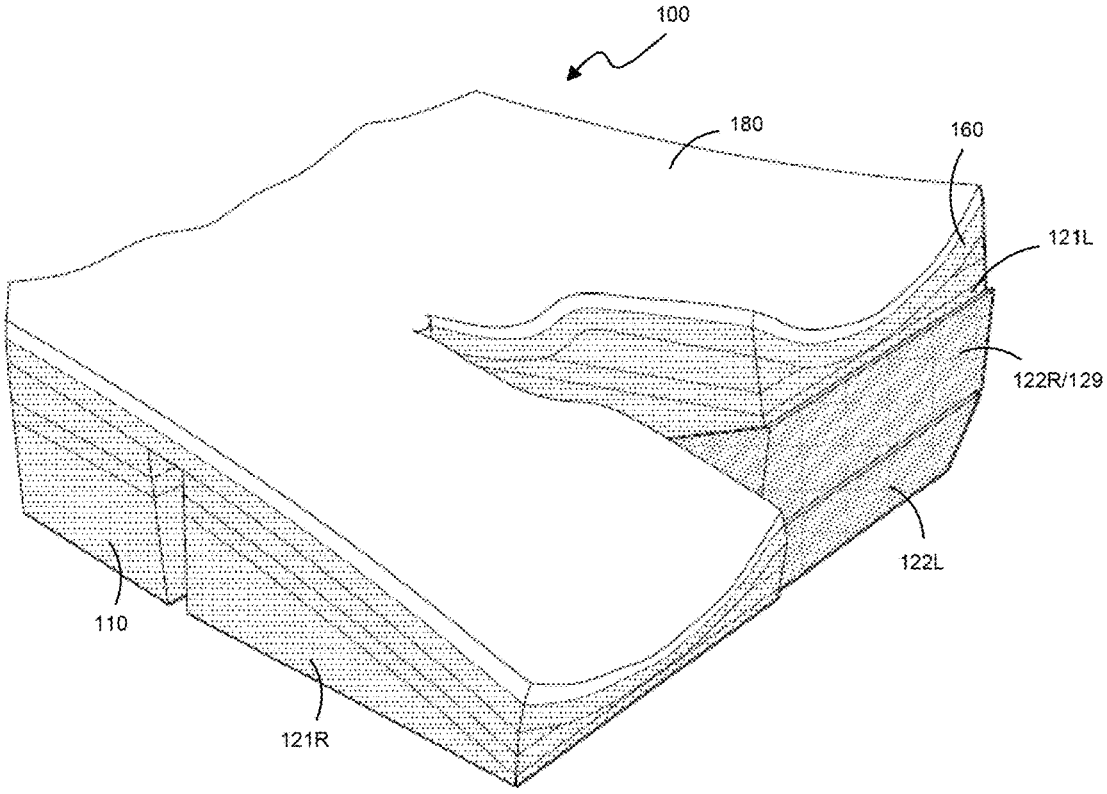
FIG. 17 is a front isometric view of the seating support of FIG. 16 where the lower part of the removed right thigh support has been inserted beneath the lower part of the left thigh support to tilt the left thigh support upwardly relative to the posterior portion of the seating support.

The upper and lower parts 121, 122, or at least the lower parts 122, may be configured to be maneuvered to modify the height and angle of the respective thigh support. For example, at least the upper part or both the upper part 121 and removable lower part 122 may be stackable on one or more inserts. In this embodiment, as shown in FIGS. 13 to 21, the lower surface 122*b* of the lower part 122 may also comprise fasteners to attach to an upper surface of an insert 129 to stack the upper and lower parts 121, 122 on top of the insert. In one form, and referring to the two thigh supports as first and second thigh supports 120' and 120" respectively, the lower part 122 of the first thigh support 120' may be used as the insert 129 after being detached from the upper part of the second thigh support 120". For example, the first thigh support 120' may be raised by inserting the lower part 122 of the second thigh support 120" between the upper and lower parts 121, 122 of the first thigh support 120', as shown in FIGS. 16 and 17. In another form, the insert 129 may be a separate part that is configured to be inserted between upper and lower parts 121, 122 of a thigh support 120 or directly beneath the upper part 121 of a thigh support where the lower part has been removed, or directly beneath the lower part 122 of a thigh support 120.

The upper part 121 of each thigh support may comprise a front region 121*c* for locating at or near the front of the thigh support and a rear region 121*d* for locating at or near the rear of the thigh support. In one form, the rear region 121*d* of the upper part 121 may have a greater thickness than the front region 121*c* of the upper part 121, as shown best in FIG. 7.

The lower part 122 of each thigh support may comprise a front region 122*c* for locating at or near the front of the thigh support 120 and a rear region 122*d* for locating at or near the rear of the thigh support 120. In one form, the front region 122*c* may have a greater thickness than the rear region 122*d*.

In one embodiment, the upper and lower parts 121, 122 are wedge-shaped. Angle adjustment inserts 122*a* of the lower part may also be wedge-shaped. The insert may also be wedge-shaped, but could also be other shapes, such as a quadrilateral shape for example. However, a wedge shape is preferred.

The upper part 121 may comprise a single section/part, as shown in FIGS. 3 to 22 and 27*b*. In this form, the upper part comprises a lower surface, at least a portion of which is inclined toward the front of the thigh support 120. Alternatively, the upper part 121 may comprise multiple sections/parts. In one embodiment, as shown in FIGS. 23 to 31, the upper part comprises a support section 121*c* and a removable base section 121*d* that is locatable beneath the support section 121*c*. The lower surface of the upper part 121 is inclined toward the front of the thigh support. In one form, the support section comprises a lower surface, at least a portion of which is inclined toward the front of the thigh support 120. In a preferred form, the lower surface of the support section 121*c* comprises a generally flat region at the rear and a sloping/inclined region at the front. The removable base section 121*d* comprises an upper surface and a lower surface and is locatable beneath the support section so that the lower surface of the removable base section and the inclined portion of the lower surface of the support section form a generally contiguous lower surface of the upper part 121 that is inclined toward the front of the thigh support 120. For example, the removable base section 121*d* may be wedge shaped. In one form, the angle of incline of the lower surface of the wedge/base section 121*d* may generally correspond with the angle of incline of the lower surface of the support section 121*c*.

The lower surface of the upper part 121 is preferably configured to form a flat contact surface with the seat base of a chair when the lower part 122 is removed from the thigh support 120 in entirety, as shown in FIGS. 27*b* and 27*c*.

In one form, the support section 121*c* and the base section 121*d* are detachably attachable via one or more fasteners, such as domes, zippers or hook and loop fasteners for example.

In one form, as shown best in FIGS. 3 to 22, 23 to 26 and 28 to 31, the lower part 122 comprises one or more removable angle adjustment members 122*c*. Preferably, the lower part comprises at least two angle adjustment members 122*c*. Each angle adjustment member 122*c* may comprise an inclined upper surface and is removably located beneath the upper part 121 of the thigh support 120. The inclined upper surface of each angle adjustment member is typically inclined toward the front of the thigh support 120. In one form, the upper surface of one or each angle adjustment member 122*c* is inclined at an angle that is generally corresponds to the angle of incline of the lower surface of the upper part 121.

Figure 23A:
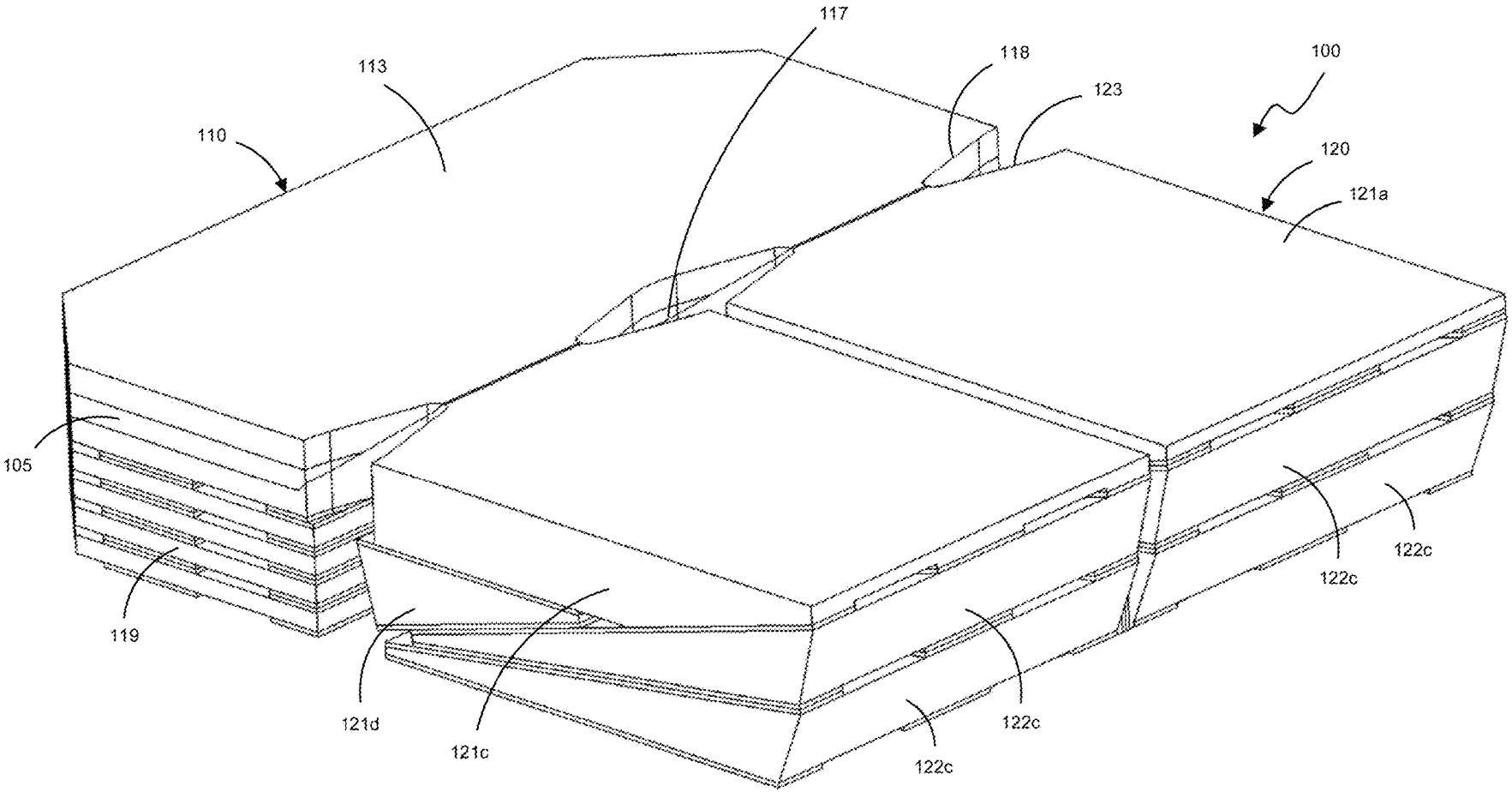
FIG. 23*a* is an isometric view of another form of seating support that comprises a pair of thigh supports comprising an upper part formed in two sections and a lower part that is also formed in two sections, the thigh supports being shown in the neutral position.
Figure 23B:
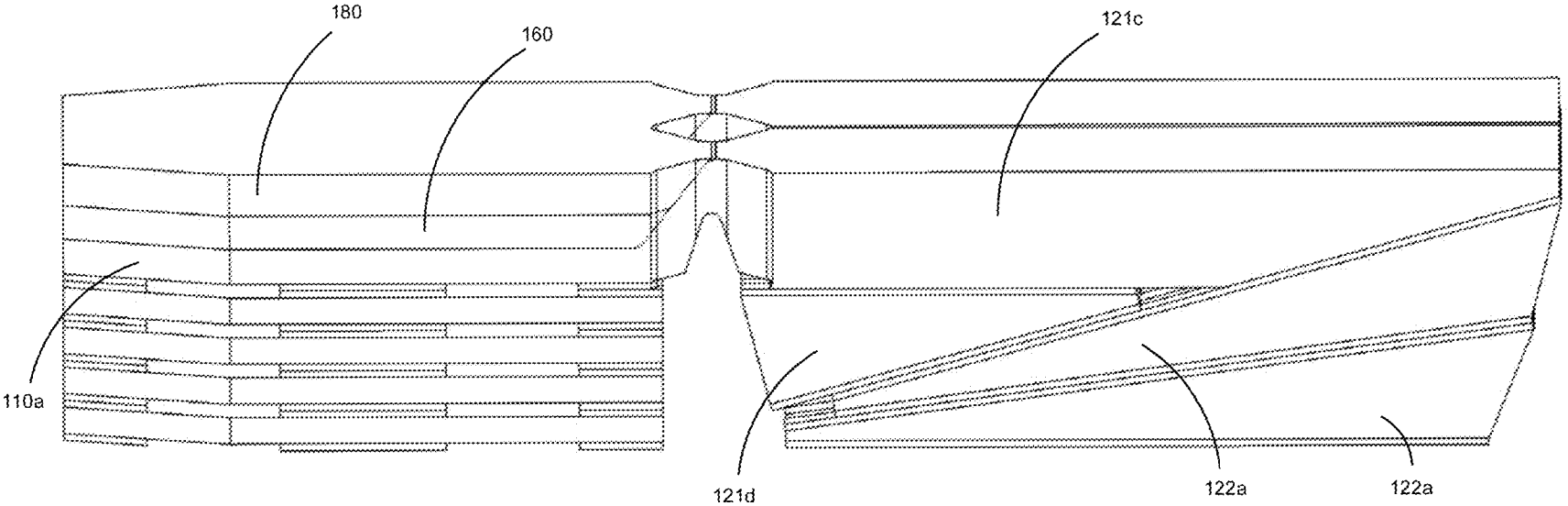
FIG. 23*b* is a side view of the seating support of FIG. 23*a;*

In a preferred form, each angle adjustment member 122*c* is wedge shaped and is stackable one on top of the other. In this configuration, each angle adjustment member may be positioned so that the narrowest point/apex of the wedge is directed toward the rear of the thigh support 120 and the opposing, widest part of the wedge is directed toward the front of the thigh support. The angle adjustment members 122*c* may be sized so that the use of no adjustment member or of a single adjustment member beneath the upper part will cause the upper part to angle downwardly toward the front, and the use of two stacked adjustment members beneath the upper part will place the thigh support in the neutral position in which the upper surface of the upper part is generally horizontal, as shown in FIGS. 23*a* and 23*b*.

To help secure the thigh supports, the angle adjustment members may be detachably attachable to each other via one or more fasteners. Similarly, the upper part and at least one of the angle adjustment members may be detachably attachable via one or more fasteners. The fasteners may be any suitable form of fasteners, such as domes, zippers, or hook and loop fasteners for example.

To vary the angle of incline of one of the thigh supports, at least one or all of the angle adjustment members of the lower part may be removed to tilt the thigh support downwardly relative to the posterior portion of the seating support, as shown in FIGS. 24 to 26 and 27*c* for example.

To increase the angle at which the upper surface of the thigh support may extend upwardly, the lower part is configurable to receive at least one insert 129. The insert 129 may be located directly beneath the upper part, or the insert may be located beneath the lower part, or the insert may be located between two angle adjustment members of the lower part. The insert 129 may be detachably attachable to at least one of the angle adjustment members 122*c* via one or more fasteners such as domes, zippers, or hook and loop fasteners for example. In one form, the insert is wedge shaped. Optionally, the insert 129 has an upper surface having an angle of incline that generally corresponds to the angle of incline of the lower surface of the upper part 121.

Figure 25:
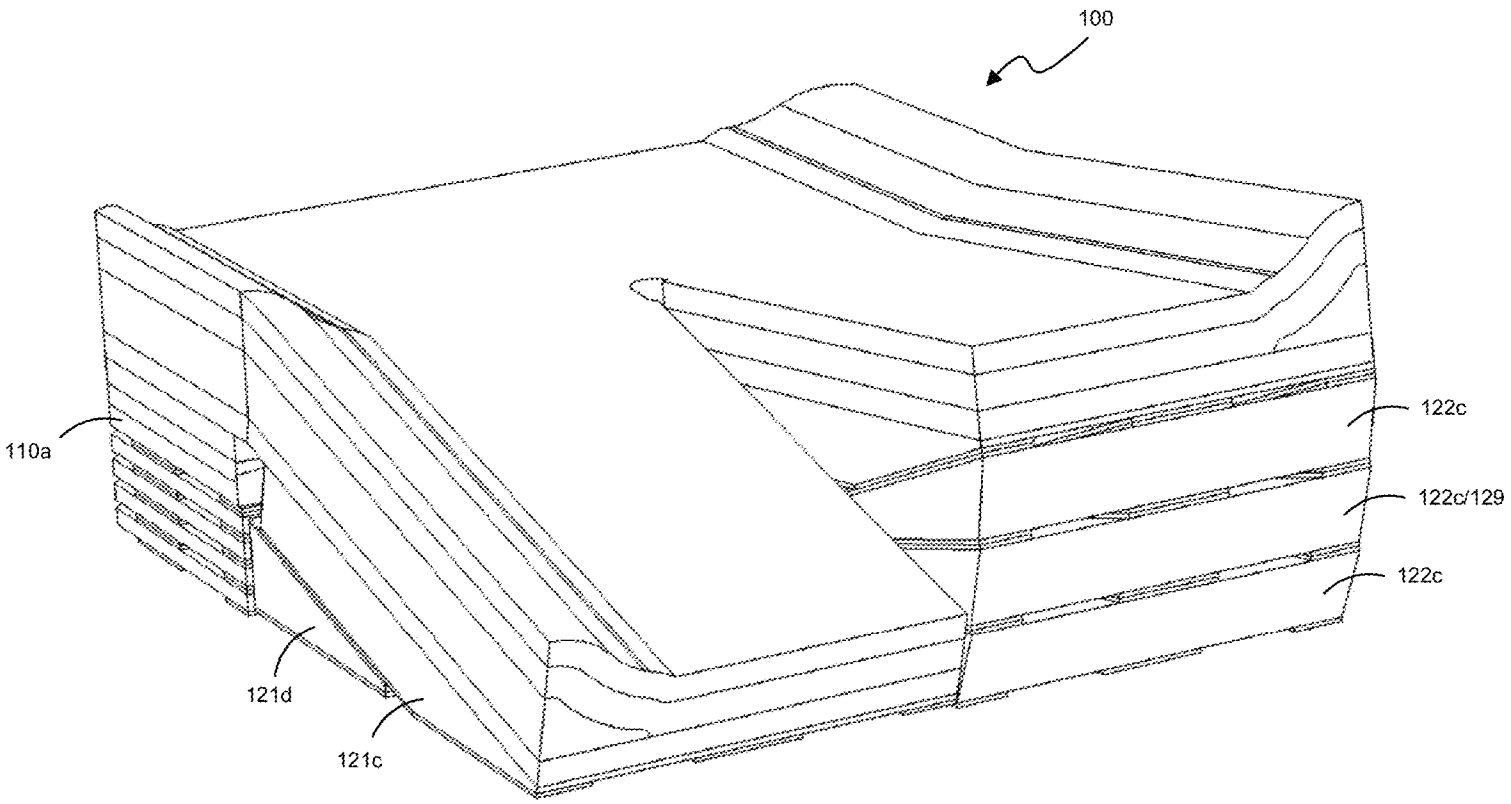
FIG. 25 is an isometric view of the seating support of FIG. 23 in which the entire lower part of one thigh support has been removed to angle the thigh support downwardly and an insert has been added to the other thigh support to angle that thigh support upwardly.
Figure 26:
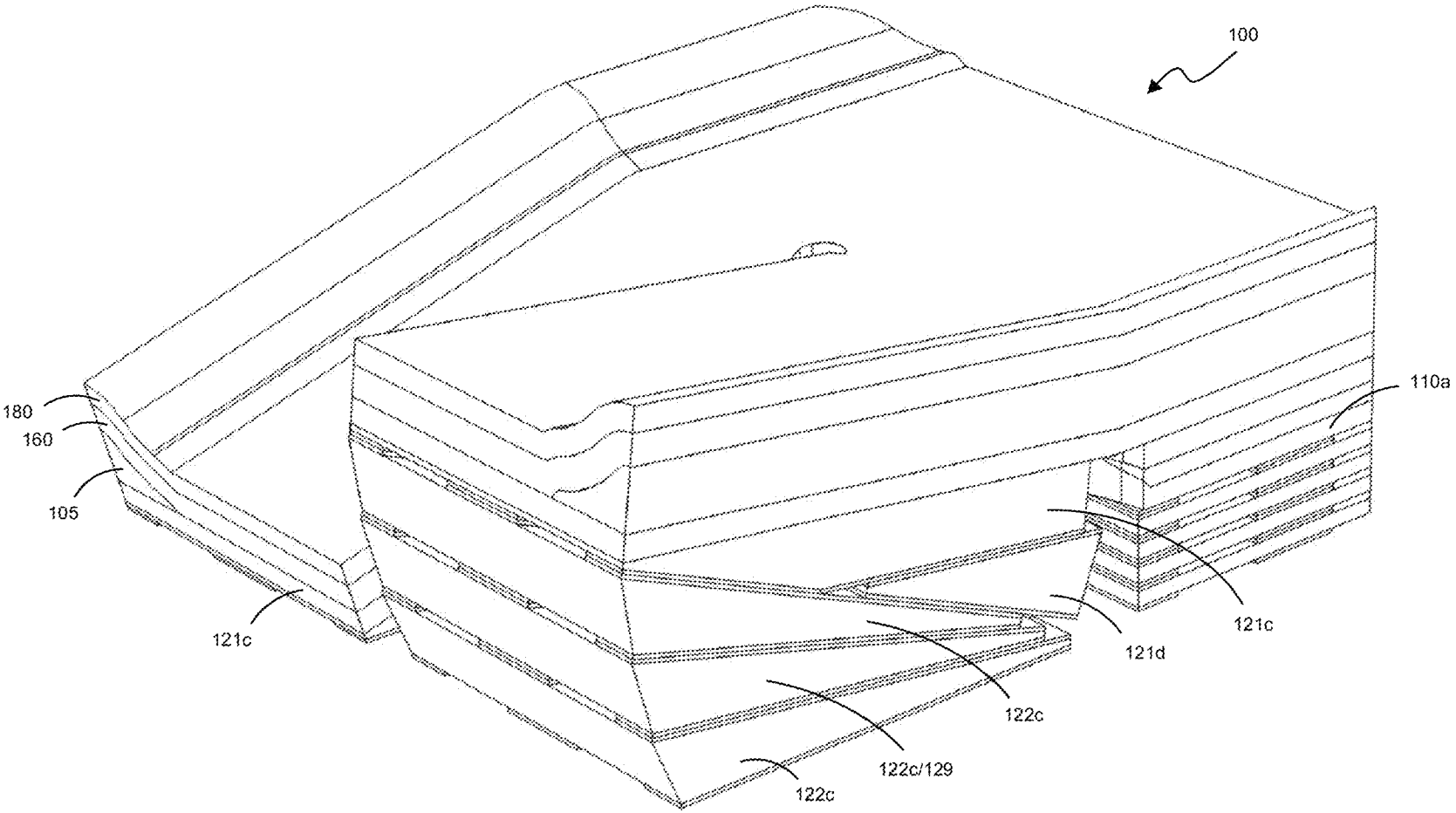
FIG. 26 is another isometric view of the seating support of FIG. 25.

In one form, the insert 129 may consist of one of the angle adjustment members 122*c* of the other thigh support 120 after being detached from the lower part 122 of the other thigh support. For example, an angle adjustment member 122*c* may be removed from the first thigh support 120' and inserted into the lower part 122 of the second thigh support 120". In such an arrangement, the first thigh support 120' may be caused to angle downwardly and the second thigh support 120" may be caused to angle upwardly, as shown in FIGS. 25 and 26.

Figure 24:
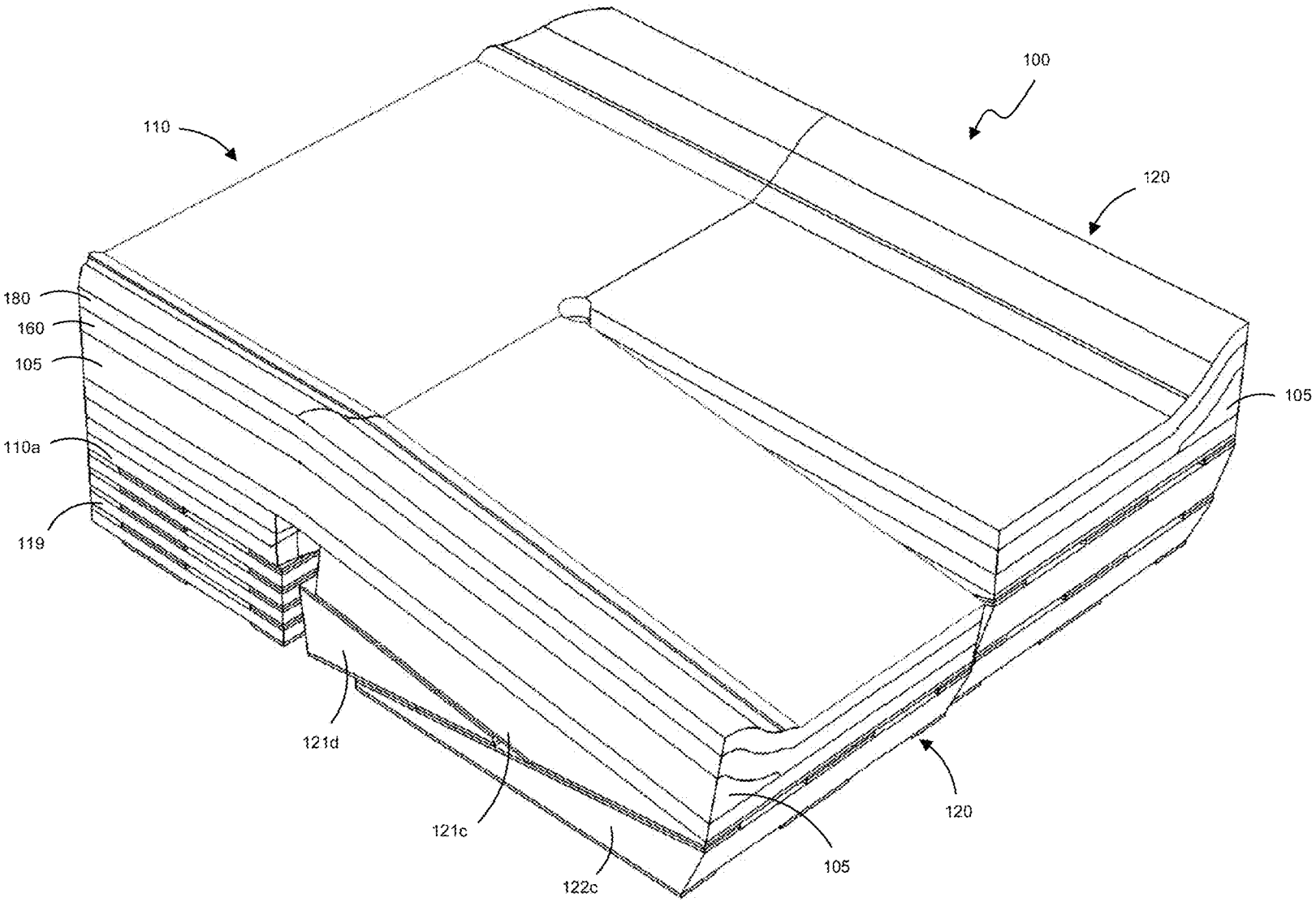
FIG. 24 is an isometric view of the seating support of FIG. 23 in which an angle adjustment member of the lower part of one thigh support has been removed.

The upper and lower parts 121, 122, including the base section 121*d* and the angle adjustment member(s) 122*c* of the lower part may have a maximum height of any desired measurement to achieve a range of angles of incline to meet the user's needs. For example, the upper part and the angle adjustment member(s) may be sized to provide a 5° downward incline when a single angle adjustment member 122*c* is located beneath the upper part 121, as shown in FIG. 24. In one form, the upper part and the angle adjustment member(s) 122*c* are sized so that a 20° downward incline is achieved by removing the lower part 122 in entirety, as shown in FIGS. 25 to 27*c*. Similarly, the upper part and angle adjustment member(s) may be sized to provide a 5° upward incline of the thigh support by removing an angle adjustment member 122*c* from one of the thigh supports and inserting that angle adjustment member beneath the upper part of the other thigh support 120, as shown in FIGS. 25 and 26.

Figure 30:
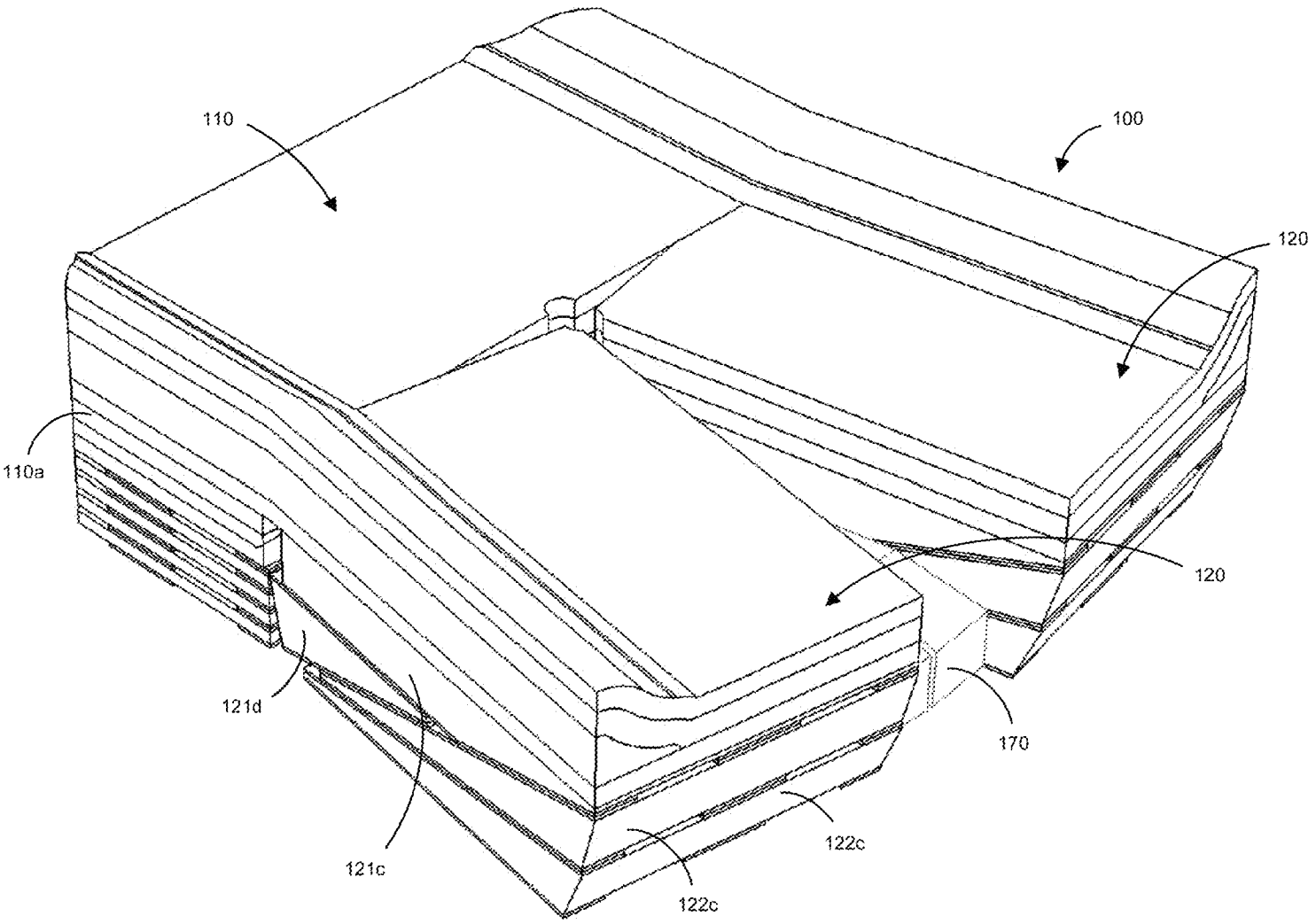
FIG. 30 is an isometric view of the seating support of FIG. 23 in which both thigh supports are externally rotated and an abduction insert is located between the thigh supports.
Figure 31:
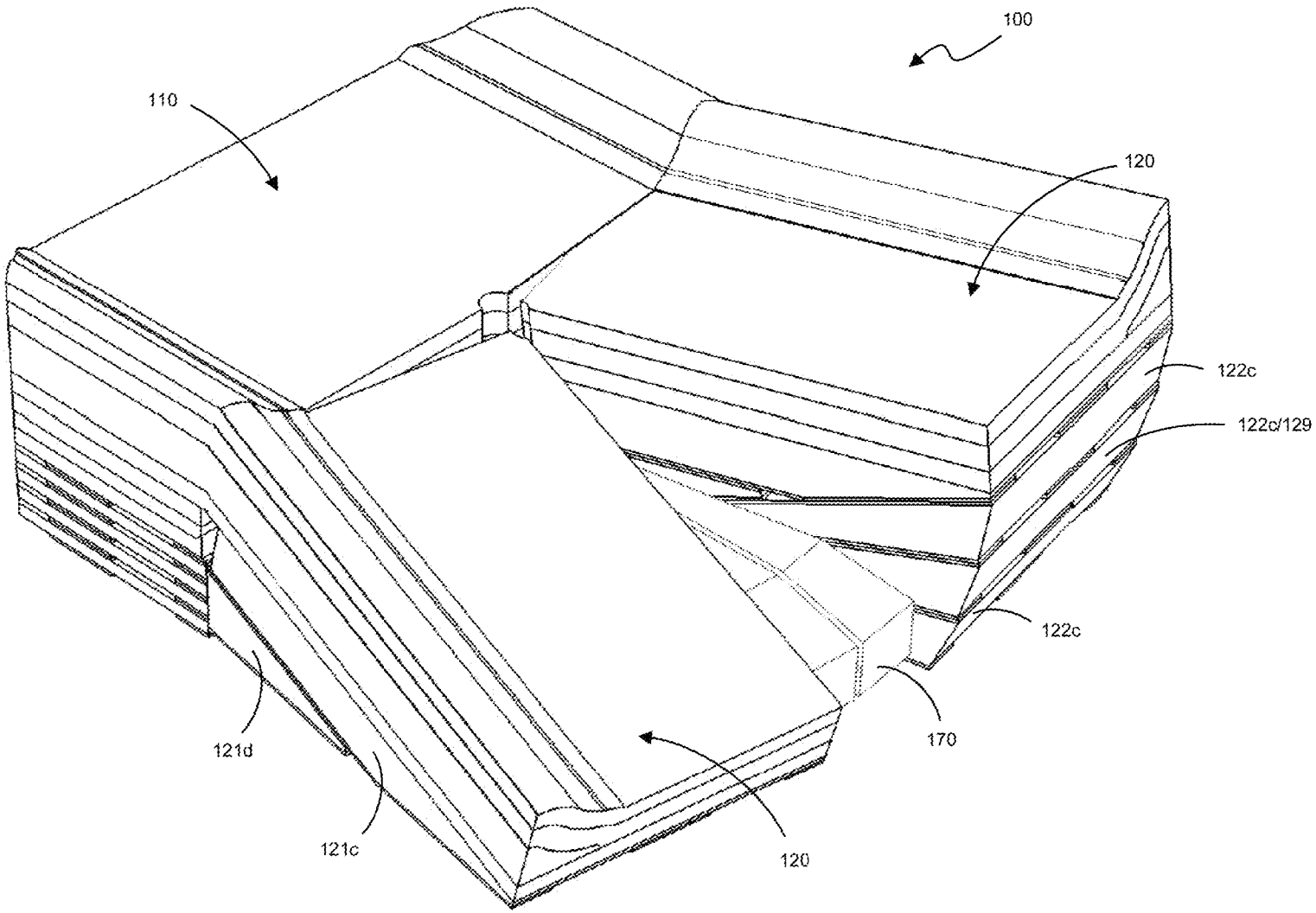
FIG. 31 is an isometric view of the seating support of FIG. 23 in which both thigh supports are externally rotated, while one thigh support is angled upwardly and the other is angled downwardly and an abduction insert is located between the thigh supports.

FIGS. 28 to 31 show one or both thigh supports of a seating support 100 in an abducted, externally rotated position. In one form, the seating support may comprise an abduction/separation insert 170 configured to be located between the inwardly facing side surfaces of the thigh supports 120 to hold one or both of the thigh supports in an externally rotated position, as shown in FIGS. 30 and 31. Typically, the abduction insert 170 comprises a wide front surface and a narrow rear surface so that sides of the abduction insert angle inwardly toward the rear. In one form, the abduction insert may be wedge shaped. The maximum width of the abduction insert 170 may be selected depending on the extent of external rotation required by the user.

Figure 32:
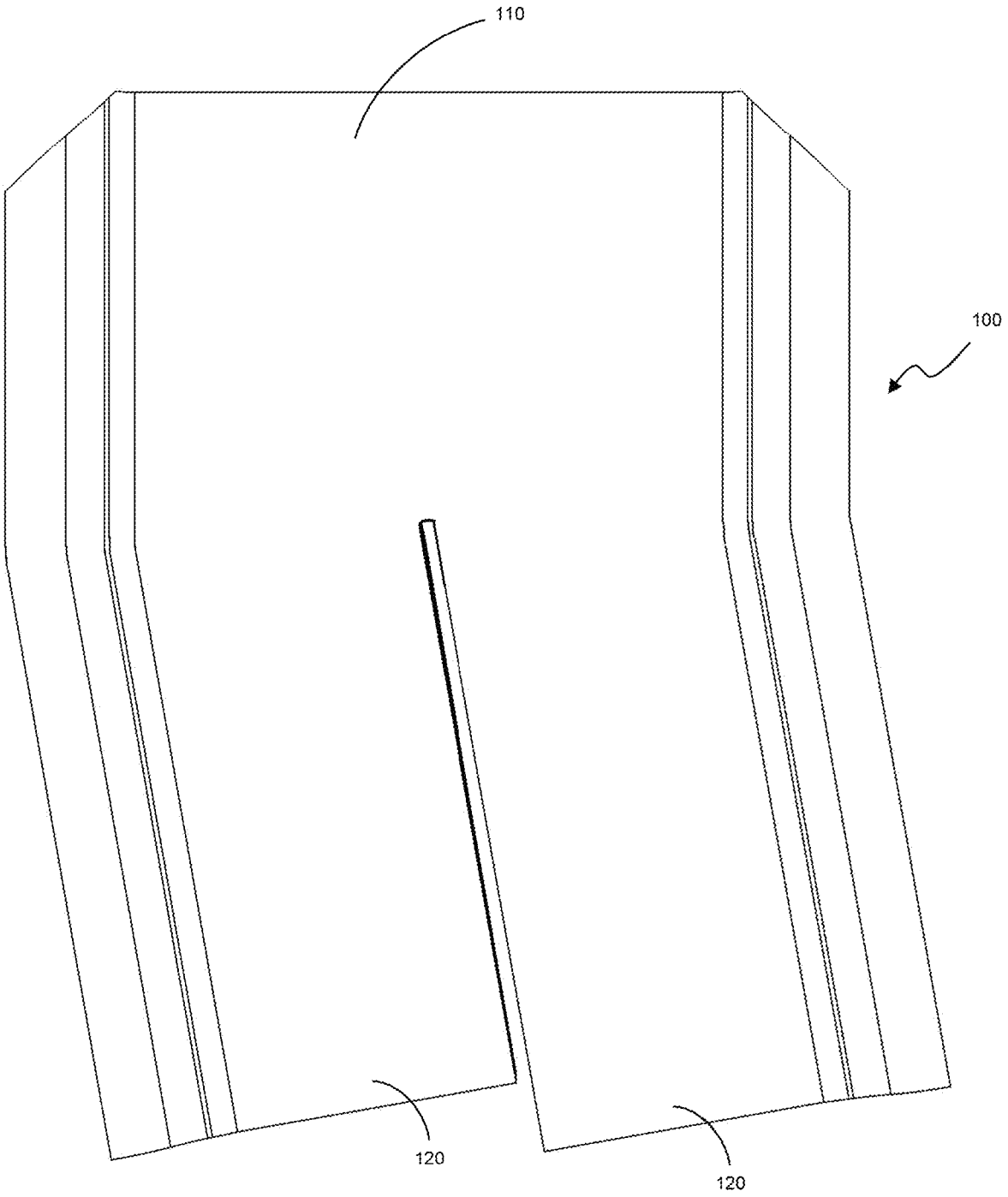
FIG. 32 is a plan view of the seating support of FIG. 23 in which one thigh support is externally rotated and the other thigh support is internally rotated.

FIG. 32 shows a seating support 100 in which one thigh support is externally rotated and the other thigh support is internally rotated.

In one embodiment, the upper surface of each thigh support 120 comprises an elongate concave channel-like depression that forms a leg well extending in a direction from the front to the rear of the thigh support 120. The leg well is configured to receive and locate an occupant's thigh on the thigh support. The leg well helps to retain the occupant's thigh centrally on the thigh support.

In one form, as shown in FIG. 8, each thigh support comprises a contouring layer 120*b* that is positioned above the upper surface of each upper part 121 of each thigh support 120 so as to rest on the thigh support. The contouring layer 120*b* comprises an upper surface having an elongate concave channel that forms a leg well 125 extending in a direction from the front to the rear of the thigh support 120. The contouring layer 120*b* may rest on the upper surface of the upper part 121 or may be attached to the upper surface of the upper part 121.

Preferably, the contouring layer 120*b* is adhered or welded to the upper surface 121*a* of the upper part 121 of the thigh support, especially if the upper part and contouring layer are each made of foam. Alternatively, the contouring layer 120*b* may be removably attached to the upper surface of the upper part 121 of the thigh support 120 by employing fasteners, such as hook and loop fasteners, between the contouring layer 120*b* and the upper part 121.

In a preferred embodiment, at least one contouring layer 110*b*/160 is also provided on the upper surface of the posterior support 110*a* of the posterior portion 110, as described above. Optionally, a single contouring layer 160 extends across both the posterior support and the thigh supports. In this form, the contouring layer 160 is attached to the upper surface of the posterior support 110*a*, and the upper surfaces of each upper part 121 of the thigh supports 120. The contouring layer comprises a posterior region and a thigh support region. A slit or cut away region is provided in the contouring layer between the first and second thigh supports to allow each thigh support to move independently of the other. In this arrangement, the contouring layer is flexible or includes a flexible connection between the posterior portion and the upper parts 121 of the thigh supports 120.

In the embodiments illustrated in FIGS. 8, 11 to 26 and 28 to 31, the contouring layer 110*b*, 120*b*, 160 is formed from at least one thin, flexible layer/sheet of material that may be shaped to provide a continuous curved upper surface. The curved upper surface of the posterior region of the contouring layer defines a central seat depression in the central region of the posterior portion. The curved upper surface of each thigh support region of the contouring layer defines the leg well of the thigh support. However, in other forms, the contouring layer 110*b*, 120*b*, 160 may be formed in a shape to provide an upper surface having the desired contours to help support an occupant of the seating support 100.

In one form, as shown in FIGS. 8, 9, 11 to 26 and 28 to 31, the seating support 100 further comprises an overlay 180 located on the upper surface of the posterior portion 110 and thigh supports 120. The overlay 180 may comprise a flexible material that allows the overlay 160 to flex as the thigh supports 120 move from one position to another. The overlay material may also be a soft, cushioning material to provide additional comfort to an occupant of the seating support 100.

The cushioning overlay 180 may extend across the posterior portion 110 and thigh supports 120 and may comprise a slit 181 or cutaway region extending from a front edge of the cushioning overlay to a central region of the cushioning overlay. The slit 181 defines a posterior region of the cushioning overlay, which is located above the posterior portion 110 of the seating support, and also defines a pair of side regions of the overlay 160, each side region being located above a respective thigh support 120. The slit 181 also allows the side regions of the overlay 180 to move independently of each other as the thigh supports 120 move from one position to another.

Figure 20:
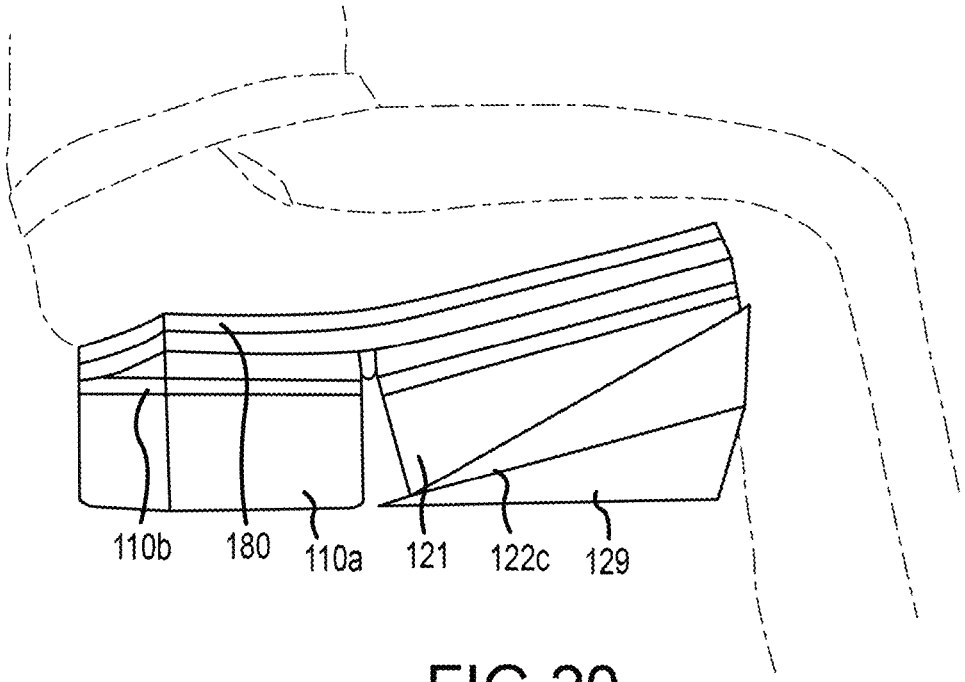
FIG. 20 is an isometric view from the side of a person sitting on the seating support of FIG. 18.

The overlay 180 may be formed of a single layer of material or multiple layers of material. In one embodiment, as shown in FIG. 20, the overlay is formed of two layers of material: a bottom layer formed of a medium density foam and a top layer formed of a low density foam.

Figure 9:
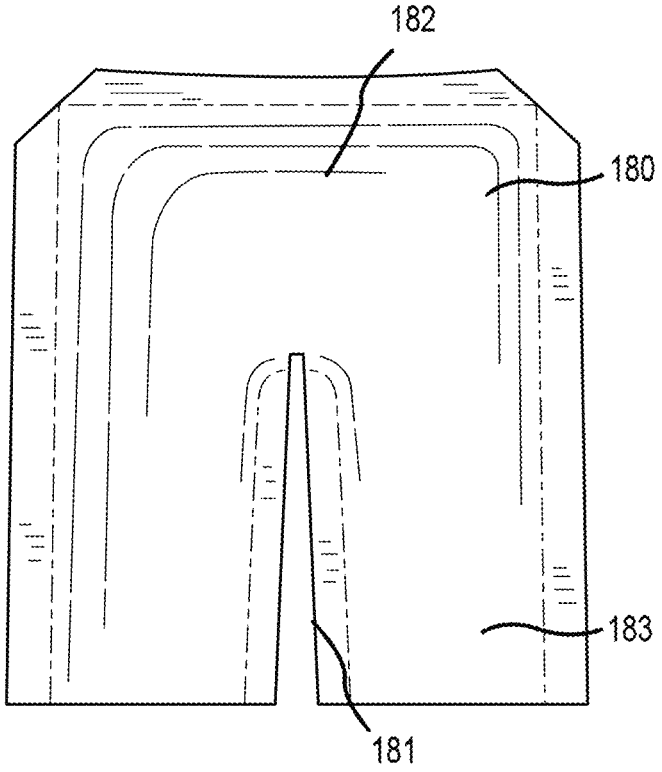
FIG. 9 is a top view of the seating support of FIG. 8.

The cushioning overlay 180 may rest on or be attached to the upper surface of the posterior portion 110 and each thigh support 120. For example, the cushioning overlay 180 may be attached to the upper surface of the posterior region of the contouring layer 110*b*, 160 and thigh support region of the contouring layer 120*b*, 160. The flexible, compliant nature of the cushioning overlay 180 allows the overlay to substantially adopt the contours of the upper surface of the posterior portion 110 and thigh supports 120. For example, as shown in FIGS. 8 and 9, the contours of the contouring layer(s) are generally adopted by the overlay 180 to provide the seating support with a central depression 182 in the posterior region, an elongate leg well 183 in each thigh support region and a raised inner region 184 of each thigh support region.

In one form, the overlay 180 is permanently attached to the posterior portion 110 and thigh supports 120, such as by adhering or welding the overlay 180 to the posterior portion 110 and thigh supports 120. In another form, the overlay 180 is removably attached to the posterior portion 110 and thigh supports 120 by adhesive or by fasteners, such as domes, zippers or hook and loop fasteners.

The contouring layer(s) 110*b*, 120*b*, 160 may be located between the upper surface of the posterior support 110*a* and the lower surface of the overlay 180 and may be configured to attach to both the posterior support and the overlay by any suitable form of fixed or removable attachment, such as adhesive, welds, domes, zippers, or hook and loop fasteners for example.

Preferably, the seating support 100 is made at least in part from a material comprising medium or high density foam. Different parts and portions of the seating support may comprise different materials. For example, the posterior portion and thigh supports may be formed from a medium or high density foam, plastic, resin, wood, metal or other firm material to provide a firm base to the seating support. The contouring layer may also comprise a high density foam, plastic, resin, wood other firm material or the contouring layer may comprise a medium density foam for additional comfort. The cushioning layer may comprise a medium density foam or a low density foam for added comfort and softness.

In one form, the seating support may also comprise a cover (not shown). The cover may be configured to encase the posterior portion, thigh supports, contouring layer(s) and overlay of the seating support. The cover may include an opening to allow access to the parts within the cover and to allow the cover to be removed and laundered or replaced. Preferably, the opening is a recloseable opening, such as a zipper opening or an opening comprising domes, buttons, hook and loop fasteners, or any other suitable arrangement for opening and closing the cover.

The cover is configured to allow the thigh supports to become thicker or thinner in depth and to move independently of each other. For example, the depth of the cover may be adjustable to allow for varying thickness of the posterior portion and the thigh supports. In preferred forms, the cover comprises an elasticated material for a snug fit and to follow surface contours of the seating support 100.

Preferred methods of using the seating support of the invention will now be described.

The seating support 100 provides an adjustable and customizable seating system in which the position, direction and angle of tilt of each thigh support can be set independently of the other thigh support. For example, each thigh support 120 may comprise a generally wedge shaped upper part, being narrower at the front of the thigh support, and a wedge shaped lower part 122 being narrower at the rear of the thigh support, and in which both the upper and lower parts are generally the same size so that the upper surface of the thigh support is substantially horizontal to form a neutral position for the thigh support 120. In another form, the upper part 121 may comprise a support section 121*c* and a base section 121*d*. Alternatively, or additionally, the lower part 122 may comprise one or more angle adjustment members 122*c*. It is possible to adjust the angle of the upper surface of each thigh support by removing the lower part 122 or at least one of the angle adjustment members 122*c* of the thigh support to cause the thigh support 120 to angle/tilt downwardly; or by adding an insert or second lower part 122 or angle adjustment member 122*c* to the thigh support to cause the thigh support 120 to angle/tilt upwardly.

Figure 11:
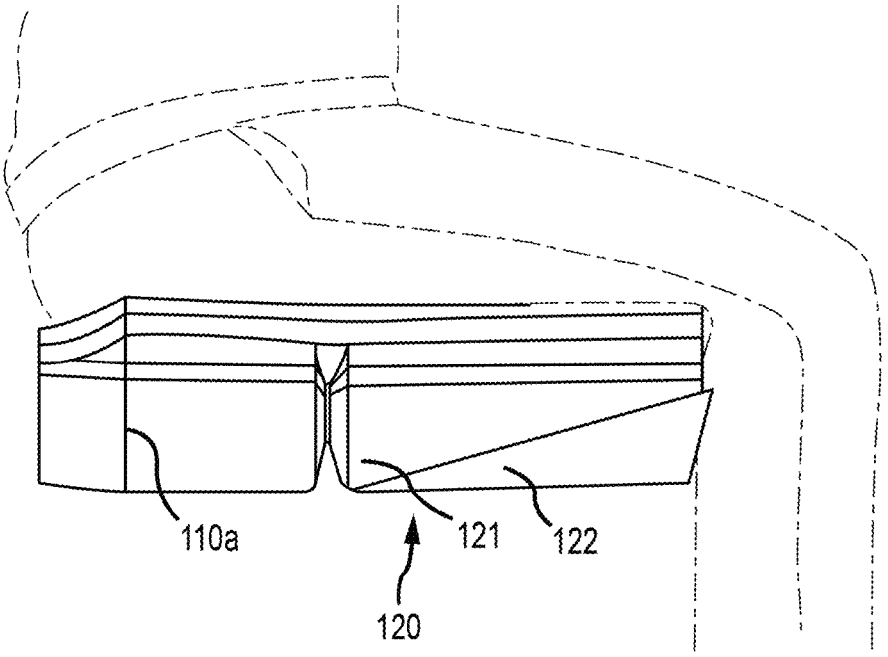
FIG. 11 is a side view of a person sitting on the seating support of FIG. 8.
Figure 12:
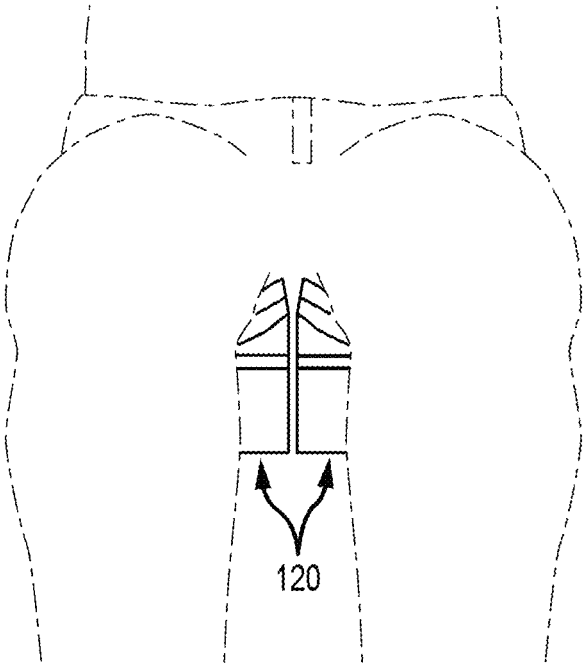
FIG. 12 is a front view of a person sitting on the seating support of FIG. 8.

FIG. 8 shows one form of seating support 100 in which both thigh supports 120 include an upper part 121 and a lower part 122 so that the upper surface of each thigh support 120 is substantially horizontal to lie in substantially the same plane as the posterior portion 110 of the seating support 100 and the two thigh supports lie substantially parallel to each other. In this arrangement, both thigh supports 120 of the seating support 100 are in the neutral position. FIGS. 11 and 12 show a person sitting on the seating support when both thigh supports are in the neutral position.

Figure 13:
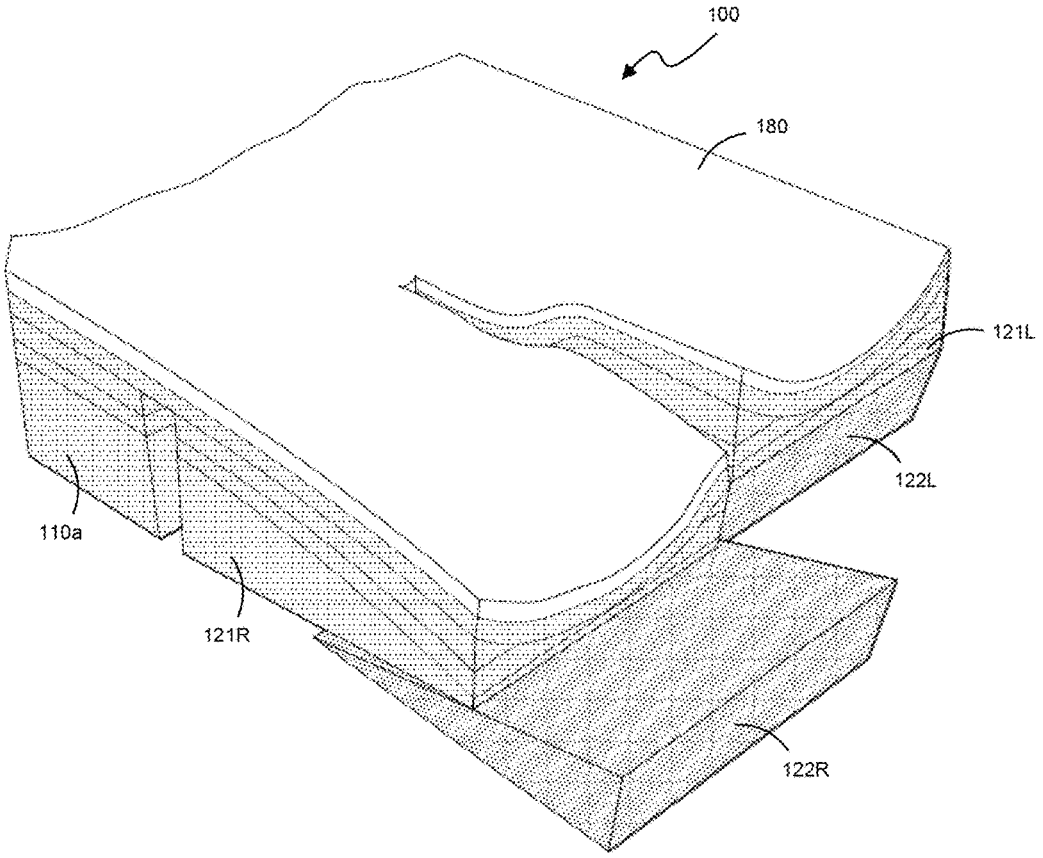
FIG. 13 is a front isometric view of the seating support of FIG. 8 with the lower part of the right thigh support being removed.

However, some people may require one leg, such as the right leg for example, to angle downwardly. To cater for this need, the lower part 122 of the relevant thigh support 120, in this case the right thigh support 120R, is removed, as shown in FIG. 13. By removing the right lower part 122R, the upper part 121R of the right thigh support hinges/tilts downwardly relative to the posterior portion 110 by flexing about the respective flexible connection 130. The left thigh support 120L remains in the neutral position, as shown in FIGS. 14 and 15. The lower part 122R of the right thigh support may be stored separately for safe keeping or later use.

Figure 18:
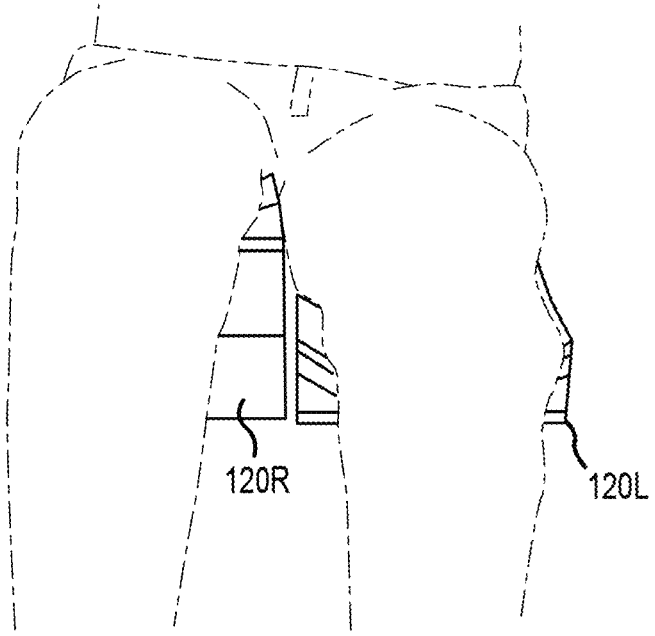
FIG. 18 is a front view of a person sitting on a seating support having a similar stacked configuration as that of the support shown in FIGS. 16 and 17, but where the right thigh support is angled to tilt upwardly and the left thigh support is angled to tilt downwardly relative to the posterior portion.
Figure 19:
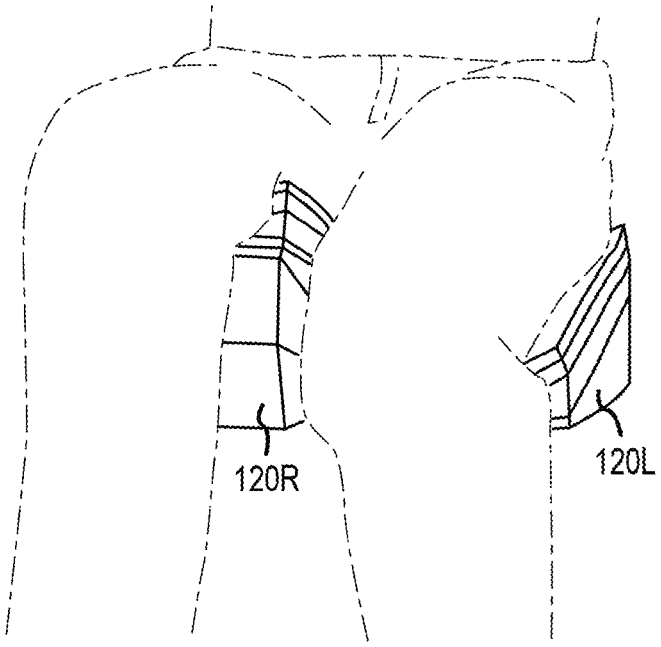
FIG. 19 is an isometric view of a person sitting on the seating support of FIG. 18.

Another occupant may require one leg to be angled/tilted downwardly and the other leg to be angled/tilted upwardly. This need can also be met with the seating support of the invention, by removing the lower part 122 of the thigh support 120 to be tilted downwardly and then using that part as an insert to place under the upper part 121 of the thigh support 120 to be tilted upwardly. For example, following from the scenario above when the lower part 122R of the right thigh support 120R has been removed to tilt the right thigh support downwardly, the removed lower part 122R may then be inserted beneath the upper part 121L of the other thigh support 120L. The removed right lower part 122R may be inserted anywhere beneath the left upper part 121L, such as between the upper and lower parts 121L, 122L of the left thigh support, as shown in FIG. 16, or beneath the left thigh support 120L, as shown in FIG. 17. In this arrangement, the right thigh support 120R tilts downwardly and the left thigh support 120L tilts upwardly relative to the posterior portion of the seating support 100. FIGS. 18 to 20 show a person sitting on the seating support 100 having a similar stacked configuration but for opposite thigh supports so that the right leg is tilted downwardly and the left leg is tilted upwardly relative to the posterior portion 110 of the seating support 100.

Where the lower part of the thigh support comprises two or more angle adjustment members, the maximum downward angle of tilt can be achieved by removing the entire lower part from the thigh support (i.e. by removing all the angle adjustment members from the thigh support), as shown in FIGS. 26 and 27*c*. Alternatively, a shallower downward angle of tilt can be achieved by removing only one or some of the total number of angle adjustment members of a thigh support, as shown in FIGS. 24 to 26. Similarly, the thigh supports can be adjusted to provide an upwardly inclined angle of tilt by adding an insert between the upper and lower parts, between two angle adjustment members or beneath the lower part, as shown in FIGS. 25 and 26. The insert may be an angle adjustment member that has been removed from the other thigh support.

Figure 21:
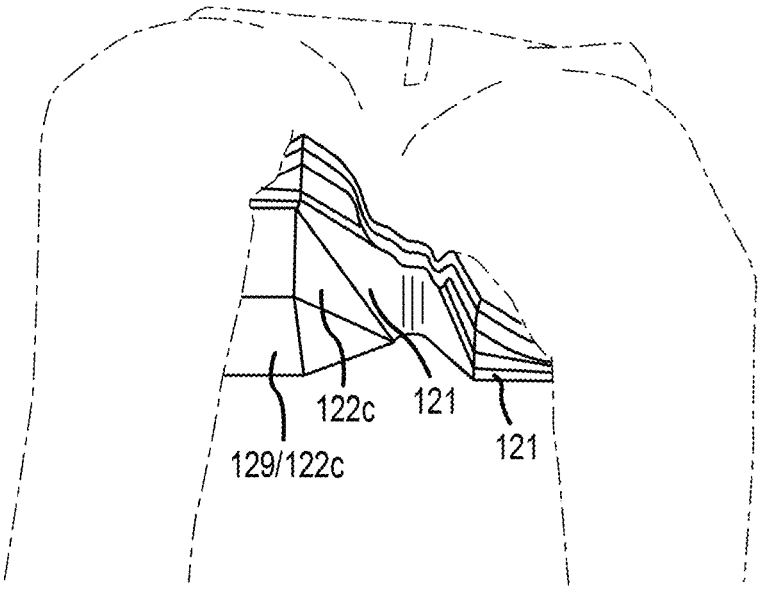
FIG. 21 is a front view of a person sitting on a seating support with the same stacked configuration as the seating support of FIG. 18, where the right thigh support is tilted upwardly and the left thigh support is tilted downwardly, but where the left thigh support is also pivoted outwardly in an abducted position.
Figure 22:
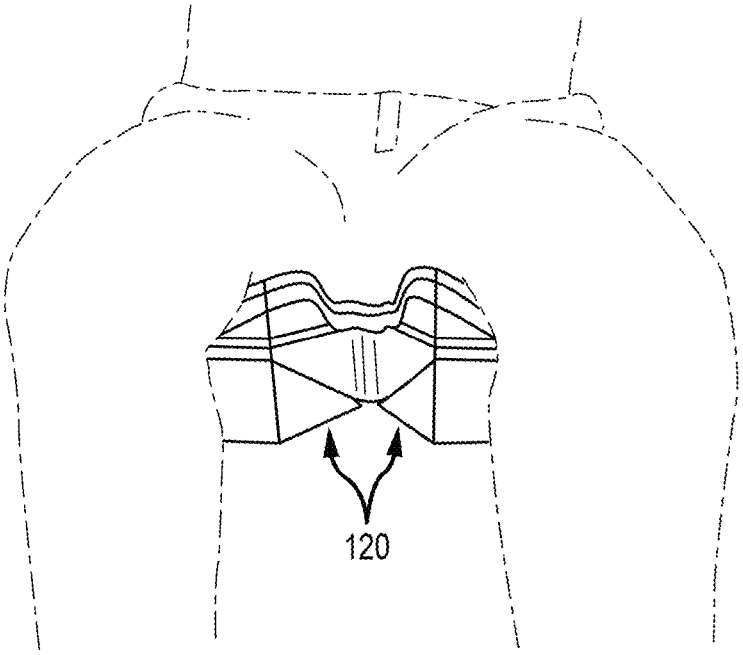
FIG. 22 is a front view of a person sitting on the seating support of FIG. 8, where the thigh supports flare outwardly from the mid-line running from the front to the rear of the seating support to form an abducted position.

The seating support 100 may also be adjusted to suit occupants who require one or both legs to angle outwardly from the mid-line that passes between the thigh supports 120 from the front to back of the seating support 100 when the thigh supports are in the neutral position. For example, some people may have an asymmetric posture so that one leg angles upwardly, downwardly or horizontally but otherwise generally projects straight forward from the hip in a front to rear direction. The other leg may angle upwardly, downwardly or horizontally but may also angle outwardly from the mid-line between the thigh supports in an abducting position and/or inwardly from the mid-line in an adducting position. For an occupant with these postural needs, the angle of tilt of the relevant thigh support(s) can be adjusted, as described above. The orientation of each thigh support may also be adjusted by pivoting the relevant thigh support (s) sideways/outwardly/externally at the front of the seating support. In this arrangement, the relevant thigh support(s) 120 may flex/rotate outwardly about the respective flexible connection(s) 130 so that the thigh supports 120 spread apart at the front of the seating support 100 to form an externally rotated position. FIG. 21 shows a person sitting on a seating support 100 with the thigh support stacking configuration of FIGS. 19 and 20, but where the right thigh support 120R is in an abducted position. FIG. 22 shows a person sitting on a seating support 100 with the configuration of FIGS. 8, 9, and 11, but where both thigh supports 120 are flared apart in an externally rotated, abducting position. For example, the thigh supports are arranged so that they are spaced farther apart at the front of the seating support 100 than when in the neutral position. Where one or both thigh supports are in an externally rotated position, one or more abduction inserts may be placed between the thigh supports to hold the thigh supports in the externally rotated position.

In yet another configuration (not shown), one thigh support may be internally rotated/adducted and the other thigh support may be externally rotated/abducted. In this arrangement, the internally rotated thigh support is angled toward the other thigh support and the externally rotated thigh support is angled away from the internally rotated thigh support. This configuration is useful for occupants with legs that tend to turn to one side.

The customizable seating support 100 therefore provides for an occupant's thighs to be at different angular positions in the vertical and horizontal directions and for the thighs to be positioned independently of each other.

The invention may also be said broadly to consist in the parts, elements and features referred to or indicated in the specification of the application, individually or collectively, in any or all combinations of two or more of said parts, elements or features.

Where, in the foregoing description reference has been made to integers or components having known equivalents thereof, those integers are herein incorporated as if individually set forth.

It should be noted that various changes and modifications to the presently preferred embodiments described herein will be apparent to those skilled in the art. Such changes and modifications may be made without departing from the spirit and scope of the invention and without diminishing its attendant advantages. It is therefore intended that such changes and modifications be included within the scope of the invention. For example, although some embodiments described herein allow for an insert to be positioned directly beneath the upper part or the lower part of a thigh support, other forms allow for an insert to be positioned above the upper part of the thigh support, such as between the upper part and contouring layer(s) 110*b*, 120*b*, 160 or between the contouring layer(s) 110*b*, 120*b*, 160 and the overlay 180.

I claim:

1. An adjustable seating support for use as a seat base to provide customized postural support to a user of the seating support, the seating support comprising a posterior portion for receiving the user's posterior thereon, a first thigh support for receiving one of the user's thighs thereon and a second thigh support for receiving the other of the user's thighs thereon, wherein the posterior portion is separated from each of the first thigh support and the second thigh support by a gap at least partially defined by (1) a recessed region provided on at least one of a substantially central region of a front surface of the posterior portion and a rear inner corner of each thigh support, and (2) a cutaway region provided on at least one of the front surface of the posterior portion proximate opposing sides of the posterior portion, and a rear outer corner of each thigh support; and wherein a virtual mid-line passes between the thigh supports from front to back of the seating support, and wherein each thigh support is connected to the posterior portion via a multi-directional connection disposed in the gap that allows the position of each thigh support to be independently adjustable, such that each thigh support is:

tiltable upwardly and downwardly about the multi-directional connection and relative to the posterior portion;

rotatable outwardly from the mid-line and about the multi-directional connection to externally rotate away from the other thigh support to form an abducted position;

wherein the first thigh support is externally rotatable outwardly from the mid-line and away from the second thigh support to form an abducted position and the second thigh support is internally rotatable toward the first thigh support in an adducted position, so that both the first and second thigh supports are rotated toward one side of the seating support;

wherein each thigh support comprises a front, a rear, an upper part and a lower part, and wherein the upper part connects the thigh support to the posterior portion via the multi-directional connection;

wherein the upper part comprises a support section and a removable base section; and wherein the support section comprises a lower surface, a portion of which is inclined upwardly toward the front of the thigh support; and wherein the removable base section comprises a lower surface and is removably located beneath the support section so that the lower surface of the removable base section and the inclined portion of the lower surface of the support section form a generally contiguous lower surface that is inclined upwardly toward the front of the thigh support.

2. The adjustable seating support of claim 1, wherein the lower part is attachable to and detachable from the upper part of the thigh support.

3. The adjustable seating support of claim 1, wherein the upper part comprises an upper surface and a lower surface, and wherein the lower surface is inclined upwardly toward the front of the thigh support.

4. The seating support of claim 1, wherein the removable base section is wedge shaped.

5. The adjustable seating support of claim 1, wherein the lower part comprises one or more removable wedge-shaped angle adjustment members, wherein each angle adjustment member is located beneath the upper part and comprises an upper surface that is inclined upwardly toward the front of the respective thigh support at an angle that is generally equivalent to the angle of incline of the lower surface of the upper part.

6. The adjustable seating support of claim 5, wherein the lower part comprises two angle adjustment members.

7. The adjustable seating support of claim 5, further comprising a wedge-shaped insert that is detachably attachable to at least one of the angle adjustment members via one or more fasteners.

8. The adjustable seating support of claim 7, wherein the insert consists of one of the angle adjustment members of the other thigh support after being detached from the lower part of the other thigh support.

9. The adjustable seating support of claim 1, wherein the posterior portion comprises a posterior support that is connected to each thigh support via a respective one of the multi-directional connections, and wherein the posterior portion also comprises one or more removable height adjustment members removably located beneath the posterior support.

10. The adjustable seating support of claim 9, wherein the posterior portion comprises one or more removable obliquity members located below the posterior support and along opposing side regions of the posterior support.

11. A method of customizing the adjustable seating support of claim 1 to suit the postural support needs of the user of the seating support, the method comprising the step of locating an insert beneath the upper part of the first thigh support to tilt the first thigh support upwardly relative to the posterior portion of the seating support.

12. A method of customizing a seating support to suit the postural support needs of a user of the seating support, the seating support comprising a posterior portion for receiving the user's posterior thereon, a first thigh support for receiving one of the user's thighs thereon and a second thigh support for receiving the other of the user's thighs thereon, wherein a virtual mid-line passes between the thigh supports from front to back of the seating support, and wherein each thigh support is connected to the posterior portion via a multi-directional connection that allows the position of each thigh support to be independently adjustable, such that each thigh support is:

tiltable upwardly and downwardly about the multi-directional connection and relative to the posterior portion;

rotatable outwardly from the mid-line and about the multi-directional connection to externally rotate away from the other thigh support to form an abducted position; and wherein the first thigh support is externally rotatable outwardly from the mid-line and away from the second thigh support to form an abducted position and the second thigh support is internally rotatable toward the first thigh support in an adducted position, so that both the first and second thigh supports are rotated toward one side of the seating support, wherein each thigh support comprises a front, a rear, an upper part and a lower part;

wherein the upper part connects the respective thigh support to the posterior portion via the multi-directional connection and the lower part comprises one or more angle adjustment members; and wherein the method comprises the step of removing at least one of the angle adjustment members of the lower part of the first thigh support to tilt the first thigh support downwardly relative to the posterior portion of the seating support.

13. The method of claim 12, further comprising the step of removing at least one of the angle adjustment members of the lower part of the second thigh support.

14. The method of claim 12, further comprising the step of removing at least one of the angle adjustment members of the lower part of the second thigh support and inserting the removed angle adjustment member to a position beneath the upper part of the second thigh support.

* * * * *